US006260320B1

(12) United States Patent
Di Lorenzo

(10) Patent No.: US 6,260,320 B1
(45) Date of Patent: Jul. 17, 2001

(54) CONCRETE PANEL CONSTRUCTION SYSTEM

(76) Inventor: Nick Di Lorenzo, 68 Millwick Dr., Unit 1, Weston, ON (CA), M9L 1Y3

( * ) Notice: Subject to any disclaimer, the term of this patent is extended or adjusted under 35 U.S.C. 154(b) by 0 days.

(21) Appl. No.: 09/328,901

(22) Filed: Jun. 9, 1999

(30) Foreign Application Priority Data

Jun. 9, 1998 (CA) ..... 2240098

(51) Int. Cl.[7] ..... E04B 1/18

(52) U.S. Cl. ..... 52/414; 52/600; 52/601; 52/602; 52/250; 52/251; 52/403.1

(58) Field of Search ..... 52/602, 251, 250, 52/403.1, 600, 601

(56) References Cited

U.S. PATENT DOCUMENTS

| | | | | |
|---|---|---|---|---|
| 3,475,529 | * | 10/1969 | Lacy | 52/602 |
| 3,683,578 | | 8/1972 | Zimmerman . | |
| 4,751,803 | | 6/1988 | Zimmerman . | |
| 4,934,121 | * | 6/1990 | Zimmerman | 52/602 |
| 5,055,252 | | 10/1991 | Zimmerman . | |
| 5,493,838 | * | 2/1996 | Ross | 52/745.1 |
| 5,656,194 | | 8/1997 | Zimmerman . | |
| 5,865,001 | | 2/1999 | Martin et al. | 52/309.12 |
| 6,003,278 | | 12/1999 | Weaver et al. | 52/414 |

FOREIGN PATENT DOCUMENTS

| | | |
|---|---|---|
| 483834 | 5/1917 | (FR) . |
| 863026 | 3/1931 | (FR) . |
| 898765 | 7/1944 | (FR) . |
| 1422473 | 3/1966 | (FR) . |
| 2045625 | 3/1971 | (FR) . |

* cited by examiner

*Primary Examiner*—Carl D. Friedman
*Assistant Examiner*—Christy M. Syres
(74) *Attorney, Agent, or Firm*—Santosh K. Chari; Orange & Chari

(57) ABSTRACT

The present invention provides a concrete building panel comprising a slab having top and bottom flanges and side flanges generally defining a box, and a plurality of ribs extending between the top and bottom flanges and being parallel to the side flanges. The panels of the invention can be used to form the walls, floor or roof of a building.

10 Claims, 36 Drawing Sheets

CONCRETE PANEL CONSTRUCTION SYSTEM

The present invention relates to the field of construction. More specifically, the invention relates to a concrete panel construction system.

BACKGROUND OF THE INVENTION

Prefabricated concrete panels have been used in a variety of building applications to provide a relatively easily assembled and relatively inexpensive building. Many of the prior construction systems have a disadvantage in that they require that at least basic horizontal and vertical structural components be constructed to act as a frame to which the prefabricated panels can be attached.

U.S. Pat. No. 3,683,578 to Zimmerman, issued Aug. 15, 1972, discloses a concrete building arrangement which purportedly eliminates the requirement to pre-form the vertical support structure. In Zimmerman's arrangement, wall panels are aligned by co-operating guide means on the base of the panels and on the foundation with which the panels co-operate. While alignment of the base of the wall panels is provided by the co-operating guide means, alignment of the upper portion of the panel is achieved by a bolt means, which co-operates with reinforcing bars within the panels. The co-operation between the bolts and the bars also acts to secure adjacent panels together. One disadvantage of Zimmerman's arrangement is the requirement to preform a concrete foundation slab to support the panels.

Another disadvantage of many prior art construction methods is that they have limited utility in the construction of basements. When concrete panels are used the basement wall tends to shift laterally where the panels join during backfilling. This is a particular problem where the panels meet to form a corner. The result is that the concrete panels used in basement construction must be secured to pre-poured concrete foundation pads in a manner to prevent lateral movement. The need to pour a foundation pad reduces the advantage sought to be gained by using prefabricated concrete panels.

U.S. Pat. No. 5,493,838 to Ross, issued Feb. 27, 1996, discloses a method of constructing a basement from prefabricated concrete panels which purportedly eliminates the requirement of pre-pouring a concrete foundation pad. In Ross' method, the building site is first excavated and footings are positioned in the excavation to define the outline of the building. Prefabricated floor panels may be placed between the footings. Once the footings are in place, prefabricated, freestanding concrete corner sections are placed on the footings where it is intended that the building have a corner. A plurality of concrete panels can then be joined end-to-end between the corner sections to complete the peripheral wall. This reference does not teach a system that facilitates the construction of a second floor of a building.

In U.S. Pat. Nos. 4,751,803 and 5,656,194, there are described concrete wall panel systems wherein concrete beam and stud members are assembled to form a panel. Such panels are then arranged to form outer walls for a building. However, these references do not teach a concrete wall panel system wherein the complete panel is formed simultaneously as a unitary structure.

SUMMARY OF THE INVENTION

In one aspect, the present invention provides a concrete building panel comprising:

a slab having an outside face and an inside face and top and bottom ends and first and second sides;

the slab top and bottom ends each including a beam extending along the length thereof, both the beams extending from the inside face of the slab in the same direction perpendicular to the plane of the slab;

the slab first and second sides comprising extensions extending from the inside face of the slab, along the length of the slab and extending perpendicular to the plane of the slab in the same direction as the beams; and a plurality of ribs extending between the top and bottom ends of the slab and from the inside face of the slab, the ribs being parallel to the extensions.

BRIEF DESCRIPTION OF THE DRAWINGS

Embodiments of the present invention will be described, by way of example only, with reference to the accompanying drawings, in which.

DETAILED DESCRIPTION OF THE PREFERRED EMBODIMENTS

Figure 1:
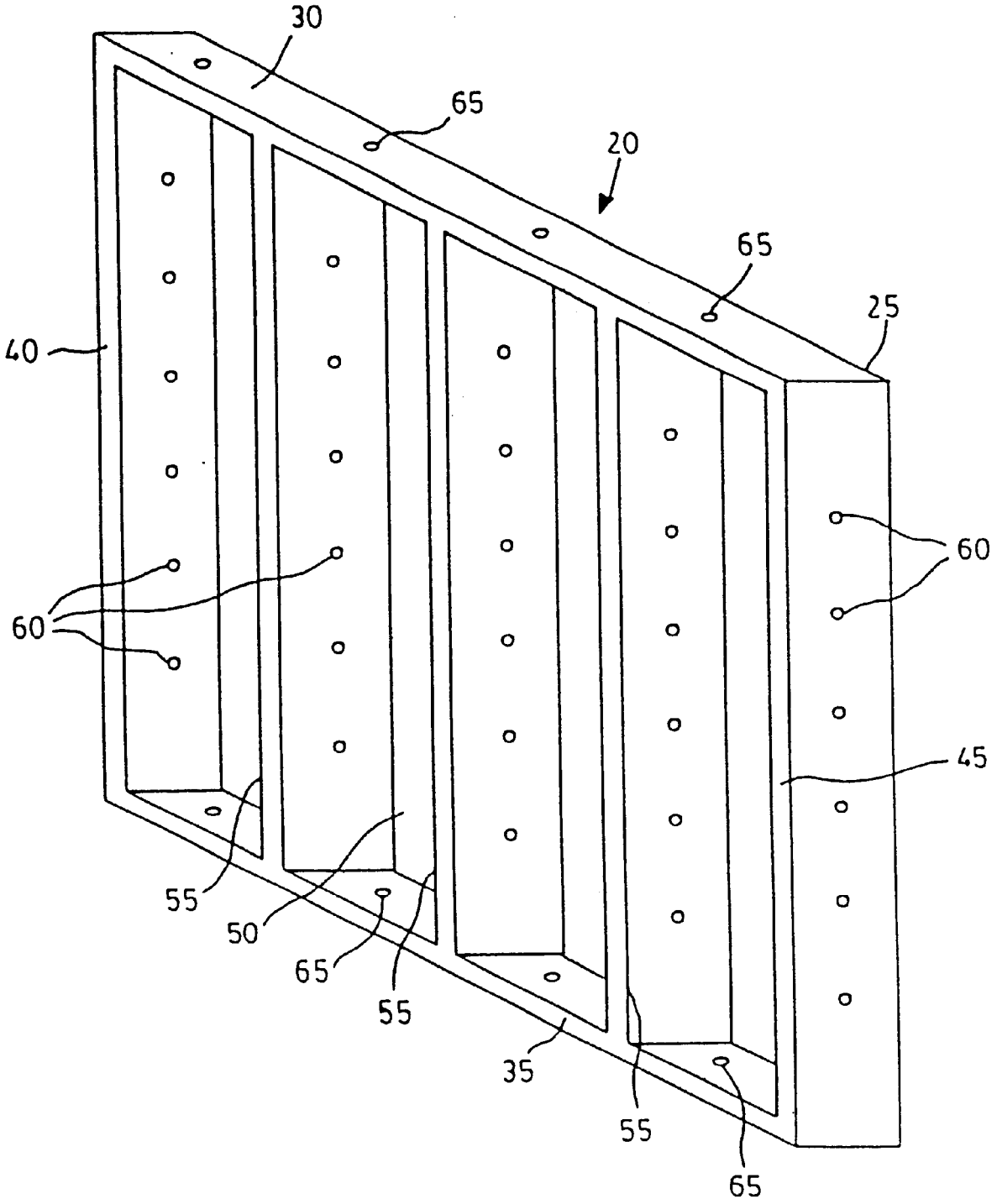
FIG. 1 is a perspective view of a building panel in accordance with a first embodiment of the present invention.
Figure 2:
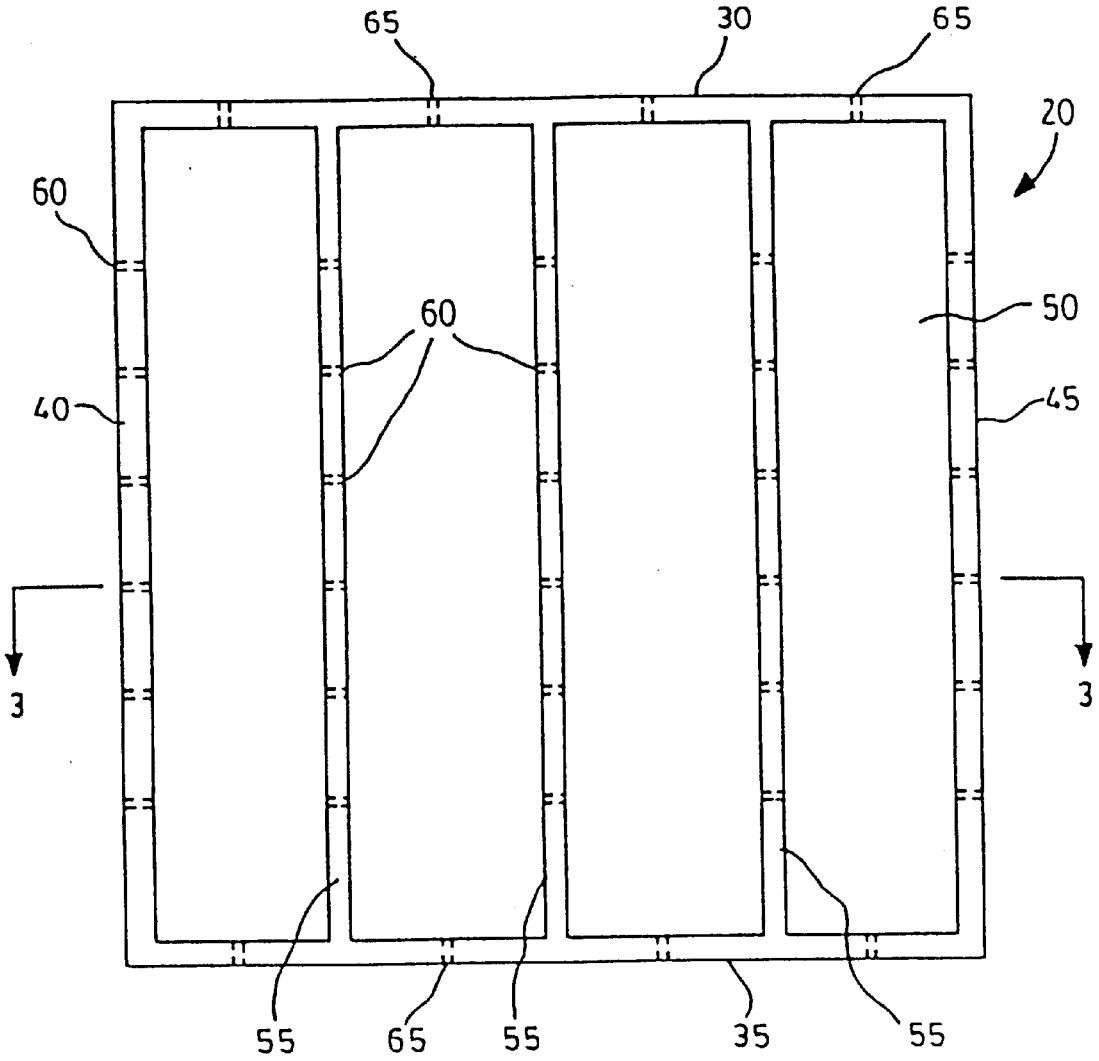
FIG. 2 is a back elevation of the panel of FIG. 1.
Figure 3:
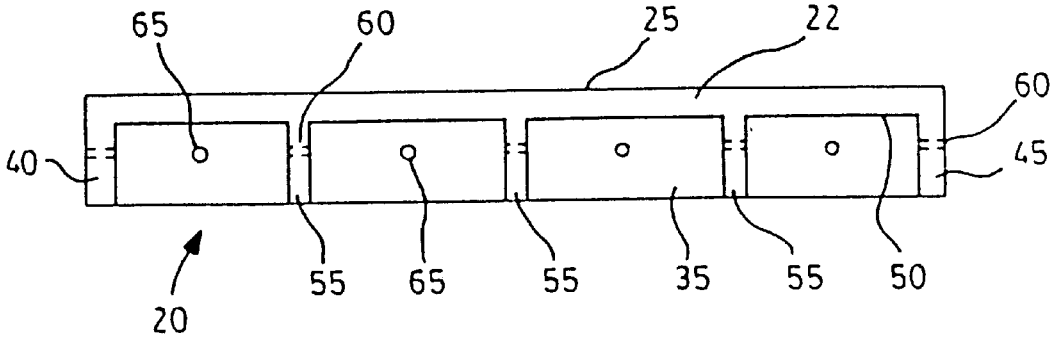
FIG. 3 is a plan section of the panel of FIG. 2, along the line 3—3.

A prefabricated concrete building panel in accordance with one embodiment of the present invention is shown generally at 20 in FIGS. 1–3. This type of building panel is particularly useful in the construction of basement walls. The building panel comprises a slab 22 having an outside face 25 and an inside face 50. The slab is integrally connected to generally parallel top and bottom beams 30 and 35, respectively, which extend from the inside face 50 of the slab. Beams 30 and 35 lie in a plane perpendicular to that of the slab 22 and extend in the same direction. The beams 30 and 35 are connected at their ends by a pair of generally vertical end ribs 40 and 45 to form a box-like structure. Between the end ribs 40 and 45 are provided a plurality of generally equally spaced, substantially vertical ribs 55 which extend between top panel 30 and bottom panel 35.

Figure 19:
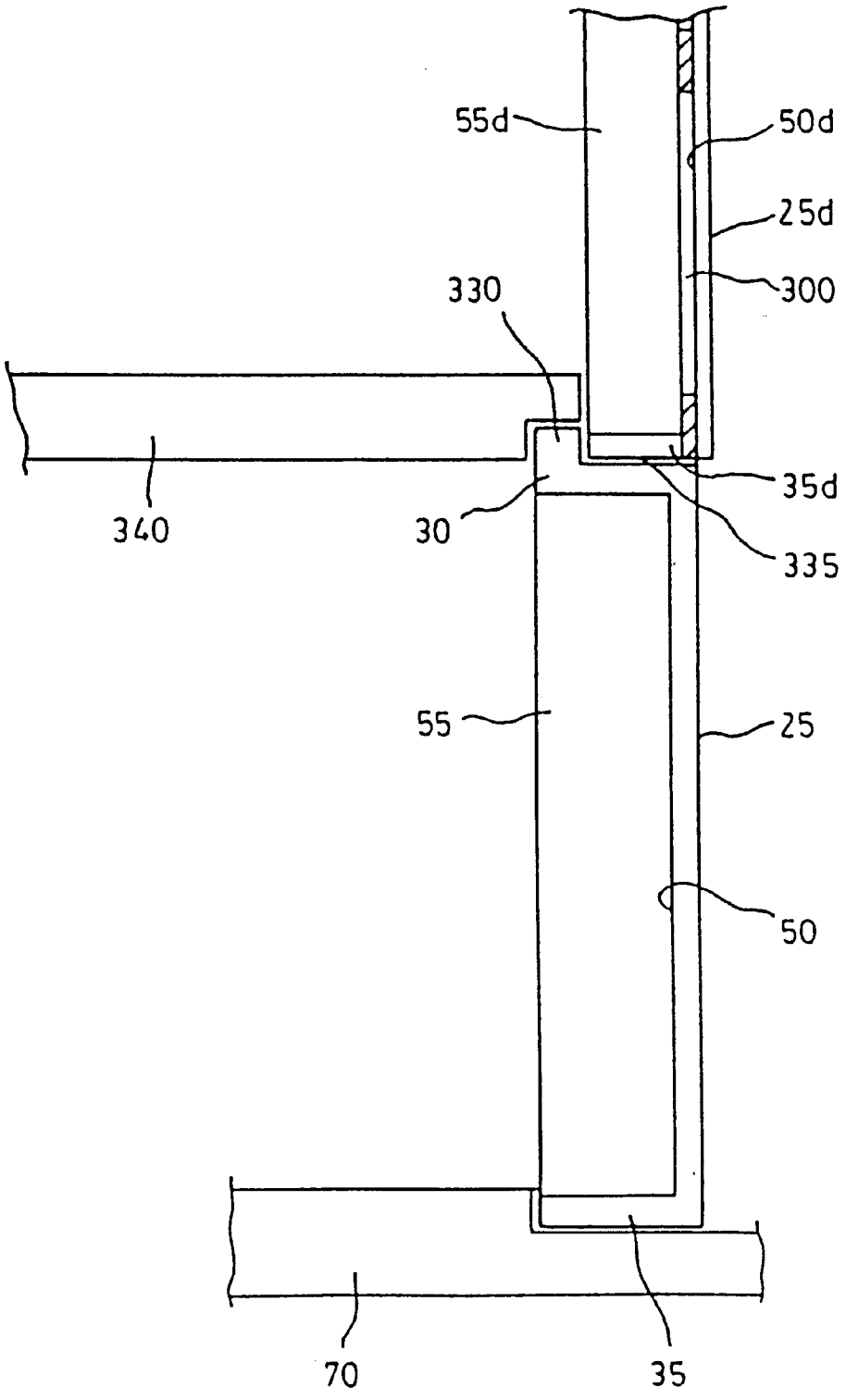
FIG. 19 is a cross-section through a wall formed by building panels in accordance with the present invention.

As will be apparent, the size of the panel is limited only by the constraint imposed by having to physically handle the panel. It is envisioned that for house construction, the panels will be approximately 8' wide by 8' high. The width of the panel will likely depend on its utility. For example, in basement construction where the panels are subject to the weight of back-filled material, and serve as foundation walls for the upper levels of the building, it is envisioned that the panels may be approximately 10" wide. A 10" wide bottom beam will help in distributing load and help stabilize the vertical panel. Similarly, a 10" top beam will provide a stable base to support a panel forming a second storey to the building and allow for support of a sub-floor structure (see FIGS. 19 and 20 and the discussion below).

It is envisioned that the slab and top and bottom beams, as well as the ribs will be reinforced, as is commonly known in the art. The reinforcement is not shown in FIGS. 1–3. Reinforcement may be in the form of steel rebars or, for example, the concrete may be reinforced with fibreglass wool or nylon strings. In one embodiment, the slab and the ribs are provided with a wire metal grid or mesh. Other reinforcement means is conventionally known in the art.

The precise dimension of the concrete panel will depend upon the particular building code in the jurisdiction in which the panel is used. However, for the remainder of this discussion the building panel will be assumed to have dimensions 8'×8'×10", with the slab 22, the top and bottom beams 30 and 35 and the ribs each having a thickness of approximately 2.5". As the exterior of the basement wall is subject to the pressure of backfilling, care should be taken to ensure that the slab 22 has sufficient strength to prevent cracking or collapse. Accordingly, it is desirable that the ribs 55, which provide rigidity and strength to the panel, are spaced apart by no more than 2'. This spacing also follows the basic building code standards of providing vertical studs at 2' separation. On this bases, a standard 8'×8' panel will have three equally spaced ribs parallel to and between the two end ribs. However, under certain circumstances the spacing between ribs 55 may vary. See, for example, FIGS. 12 and 13 and the discussion on interior and exterior corner construction.

As shown in FIGS. 1–3, the opposed end ribs 40,45 and the vertical ribs 55 are preferably provided with apertures or knock-outs 60 which can be used to facilitate running of electrical wires and plumbing through the wall cavity. Further, as will be discussed in more detail below, these knockouts can be used to receive locking bolts or a tensioning rod or belt, to permit adjacent panels to be secured together. A knock-out is a section of the beam or rib in which the thickness and strength of the concrete is less than that of the rest of the beam or rib. This weakened section may be removed on site by a builder by hitting the weakened section and "knocking-out" the concrete plug. The formation of knock-outs in concrete panels is well known in the art. As illustrated, the preferred embodiment of the invention includes apertures created during the forming process instead of knock-outs.

Figure 33A:
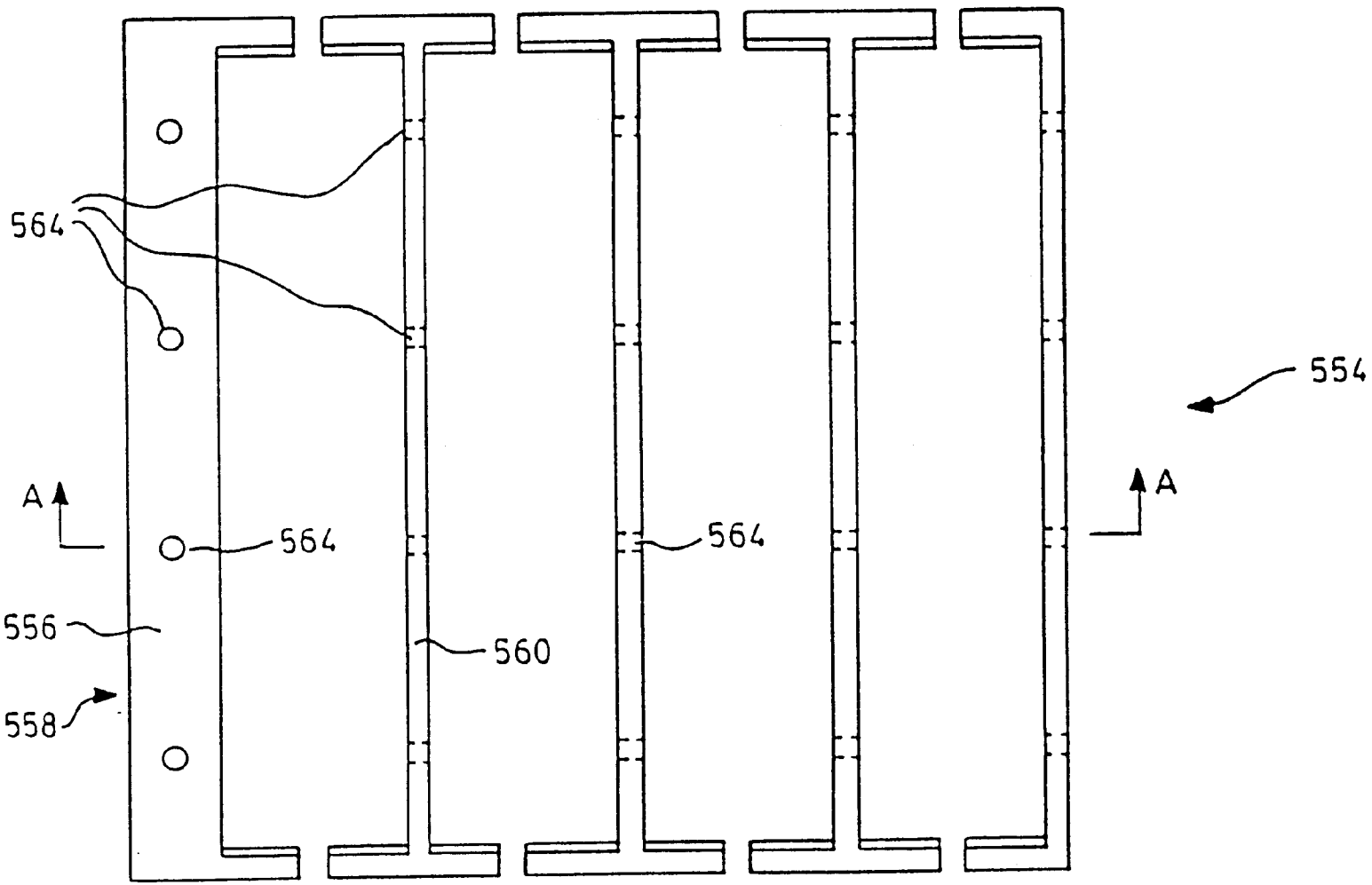
FIG. 33*a* is a front elevation of a wall panel of the invention for use in interior corners.

In the preferred embodiment, four apertures 60 are provided for each rib. The apertures are spaced so that the top and bottom apertures are spaced 1 foot from the top and bottom beams, 30 and 35, respectively. The remaining apertures are then spaced 2 feet from each other. An example of this arrangement is illustrated in FIG. 33*a* . By ensuring the same spacing of the apertures in all the panels results in all the apertures in one panel line up with those of an adjacent panel. This would greatly facilitate the connection of adjacent panels. Further, if all the panels have apertures at the same positions, it is possible to create a continuous channel throughout the building thereby facilitating the passage of electrical wire, plumbing etc.

Further apertures or knock-outs 65 may also be provided in the top and bottom beams 30, 35 to facilitate fastening the building panel to the foundation and the second storey or roof of the building. As will be apparent, the size of the knock-outs will vary depending on the size of bolts used to fasten the panels.

Figure 4:
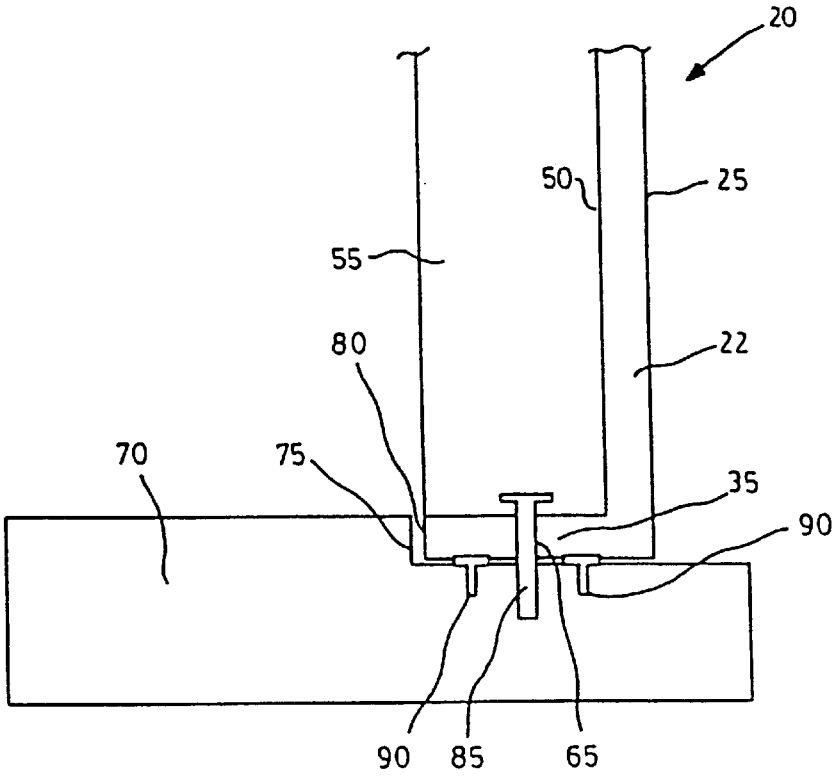
FIG. 4 is an exploded cross-section of a panel-to-footing attachment in accordance with one embodiment of the present invention.

Various types of foundation footings are shown in FIGS. 4–7. In FIG. 4, a building panel 20 is mounted on a foundation footing 70. The foundation footing 70 may, if building conditions allow, be formed from compact earth or hardcore or, more likely, will be formed from concrete. The concrete footing may be a continuously poured strip that runs the length of the wall or may be individual blocks placed under spaced locations along the length of the wall panel. In one embodiment, the footing is provided with a step 75 against which the back edge 80 of bottom beam 35 abuts. The step abutment helps prevent lateral movement of the wall in relation to the footing during backfilling against the outside face 25 of the building panel. Building panel 20 is secured to footing 70 by means of a bolt 85, which projects from the footing through aperture 65. Optionally, the footing may be provided with pair of levelling bolts 90, which project from footing 70 and abut the underside of bottom beam 35. The levelling bolts may be used to ensure that the panel lies in the desired plane when the ground under the foundation may not be sufficiently level.

Figure 5:
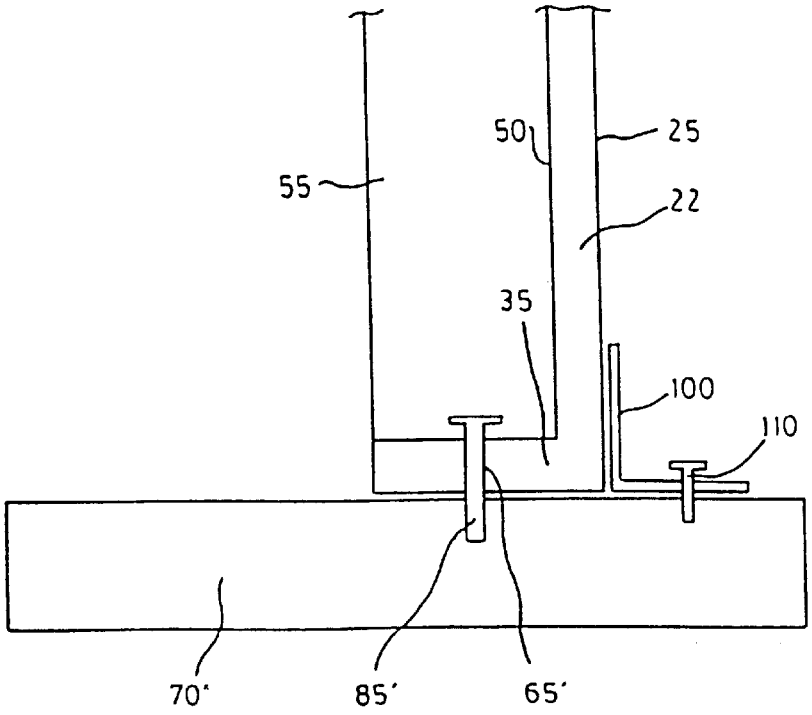
FIG. 5 is an exploded cross-section of a panel-to-footing attachment in accordance with a second embodiment of the present invention.

A footing arrangement in accordance with another embodiment is shown in FIG. 5. In this arrangement, footing 70' is provided with an angle iron or channel section 100, which may be used to facilitate, correct alignment of the building panel. Section 100 may be attached to footing 70' (with for example bolt 110) prior to having the building panel lowered into place. In this way, it is possible to mark the perimeter of the entire building on the footings with the easily manoeuvred angle sections, rather than manipulating entire concrete building panels.

Figure 6A:
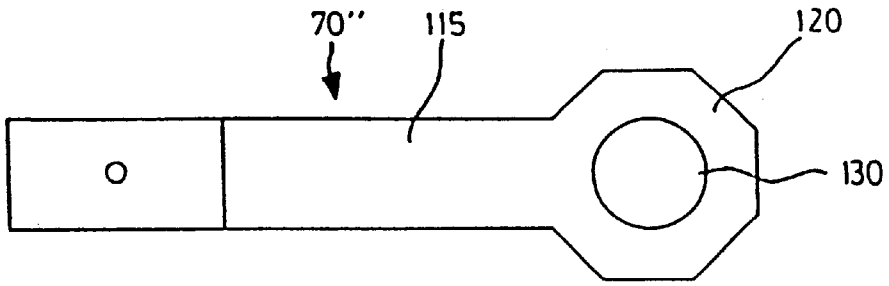
FIGS. 6A and 6B are plan and side views of a footing member in accordance with one embodiment of the present invention.
Figure 6B:
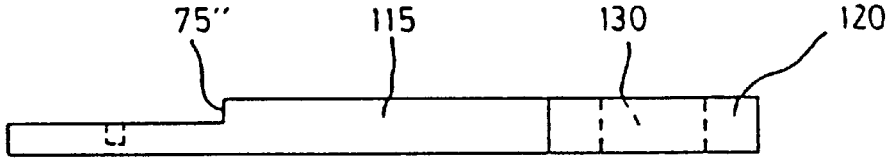
Figure 7:
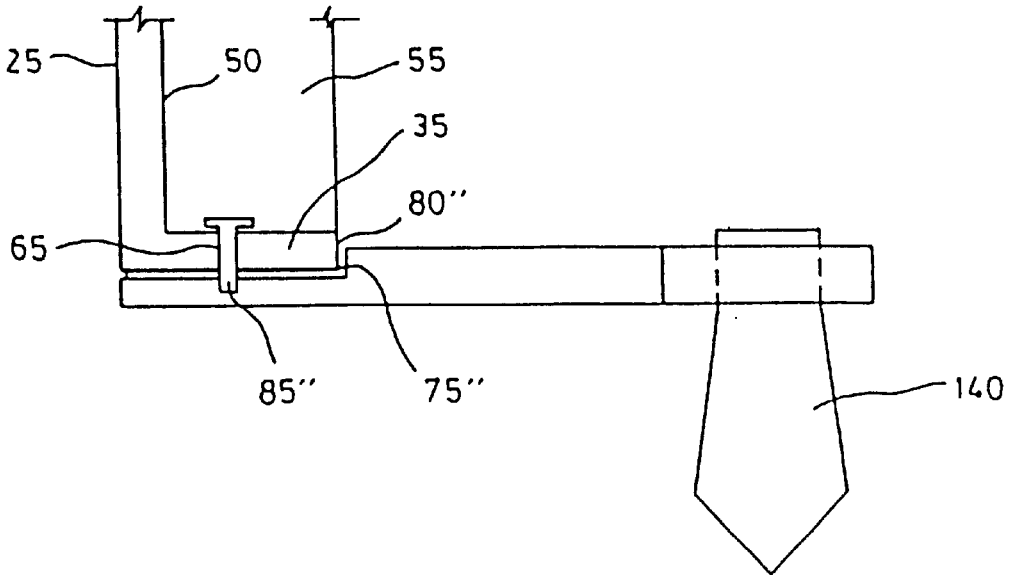
FIG. 7 is an exploded cross-section of a panel-to-footing attachment utilizing the footing of FIGS. 6A and 6B.

Yet another embodiment of the footing is shown in FIGS. 6A, 6B and 7. The footing 70 comprises an elongate body 115 and a securing head 120. One end of body 115, distal to securing head 120, is provided with a recess 75" against which the bottom beam of a building panel abuts, as described above with respect to FIG. 4. Securing head 120 is provided with an aperture 130 adapted to receive a bottom-flared spike 140, which can be formed in the ground and which prevents movement of the footing. In a preferred embodiment, the footing has an overall length of approximately 4', with the 2.5' long body having a width of 8" which is the same as the diameter of the aperture 130 in securing head 120. The footing is preferably formed of reinforced concrete and may be precast and placed in the appropriate location in the foundation or, alternatively, the footing may be cast in-place by placing a suitable mold at the desired location. The spike 140 is preferably also formed of reinforced concrete. Casting the spike in the ground provides a firm anchor for the footing; the shape of the spike helping to prevent it being lifted from the ground. Although not shown, this type of footing may also be provided with levelling bolts to facilitate alignment of the panel.

In respect of the footing shown in FIGS. 6*a*, 6*b* and 7, it is apparent that the footing does not support the entire length of the panel but usually supports only one or two points along its length. In these circumstances, it is desirable to ensure that there is a solid foundation under the unsupported panel length. This may be achieved by simply hard packing the earth where ground conditions permit or may be achieved by forming a strip of "crush and run" packable aggregate between the footings. The aggregate may be covered with a wire mesh or cloth to help distribute the load evenly across the strip, if desired.

In addition to the above described footings, it will be understood that the panels of the present invention may also be simply placed on top of a concrete slab. The exact configuration will depend upon local soil conditions.

As mentioned above, adjacent concrete panels may be attached together in an end-to-end manner by using bolts, such as pipe bolts, which pass through aligned apertures 60 in the abutting end ribs. Such bolts are described below in relation to FIG. 13.

In addition to or as an alternative to such bolt connectors, the building panels may be provided with a tensioning belt arrangement, shown schematically in FIGS. 8–11. FIG. 8*a* shows a pair of panels 20 and 20', each panel provided with a belt attachment (150 and 150') connected to one end of a rebar or tensioning belt (160 and 160'). The attachment means 150 and 150' may be located within the top or, as shown, the bottom beam of a building panel. Attachment means 150 and 150' are connected together by a bolt 170 which extends from attachment means 150', through aperture 175 and into attachment means 150 where it is secured with a nut (not shown). As shown, in the preferred embodiment of the invention, the attachment means comprise shoes, which are positioned at the upper surface of the bottom beam of each panel and extend to the outer edge of the end ribs. Such an arrangement allows easy access to the shoes 150 and 150' after the panels are set in place so as to facilitate tightening of the bolts 170.

Figure 8A:
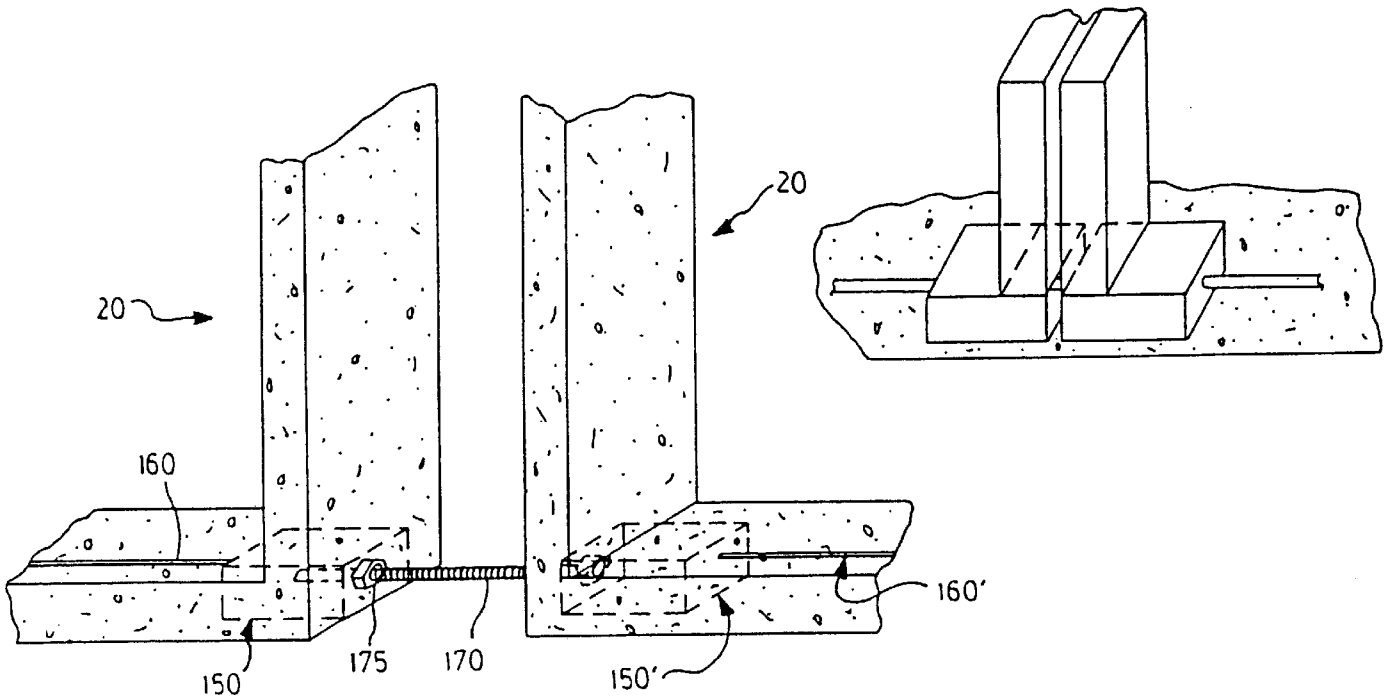
FIG. 8*a* is a perspective view of an attachment means for the bottom portions of adjacent panels of the present invention according to one embodiment.
Figure 8B:
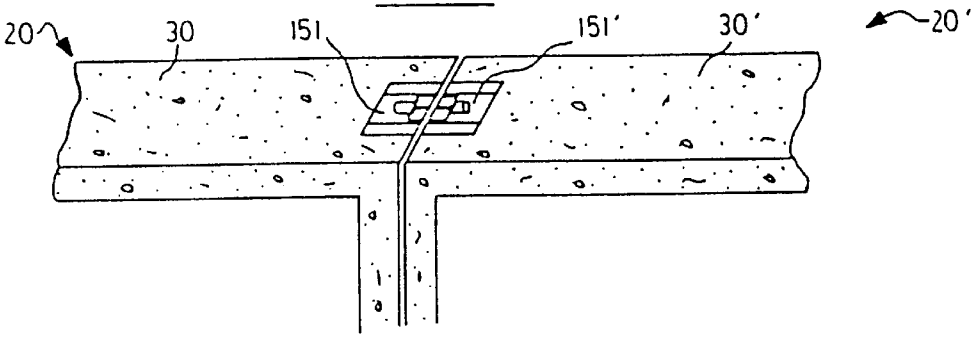
FIG. 8*b* is a perspective view of an attachment means for the top portions of adjacent panels of the present invention according to one embodiment.

FIG. 8*b* illustrates similar attachment means for the top beams 30 and 30' of adjacent panels 20 and 20'. As shown, shoes 151 and 151', similar to those discussed above, are provided on the upper surfaces of the top beams and are exposed so as to allow easy access thereto.

Figure 9:
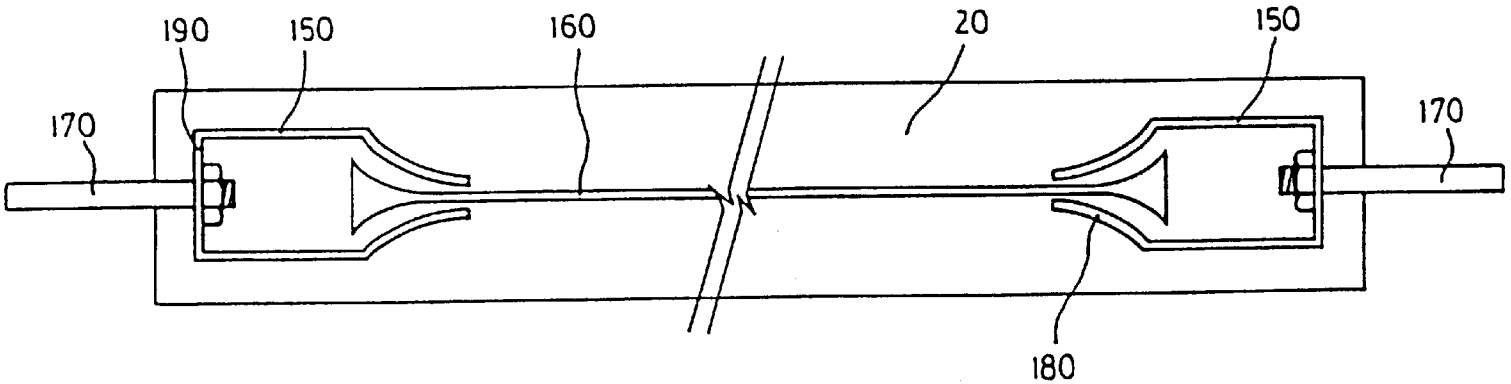
FIG. 9 is a plan view of the attachment of FIG. 8*a* according to another embodiment.
Figure 10:
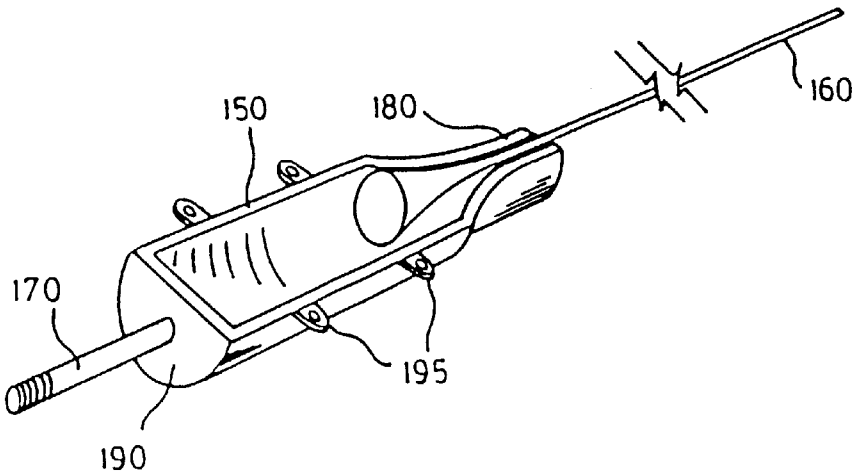
FIG. 10 is a perspective view of one end of the attachment of FIG. 9.

Another typical attachment means is shown in FIGS. 9 and 10. The attachment means generally comprises a U-shaped shoe having a crimped end 180 and a sealed end 190. End 180 is crimped around tensioning belt 160 to prevent lateral movement thereof. Sealed end 190 is provided with an aperture to receive bolt 170.

The U-shaped shoe may be provided with nail holes 195, which will help maintain the shoe in place during casting of the panel. The shoe need not necessarily be set in from the edge of the panel and in fact, sealed end 190 may be flush with the end wall. Under these circumstances, it is preferable if the shoe is slightly tapered, increasing in width away from the sealed end. This tapering will help prevent lateral movement of the shoe during tensioning of the belt.

Preferably, the tensioning belt and attachment means are cast in the top and/or bottom beams of the building panel such that the builder is permitted access to the channel of the attachment means when the panels are in place. After connection of adjacent panels, the attachment means may be scaled within the panel with concrete.

Figure 11A:
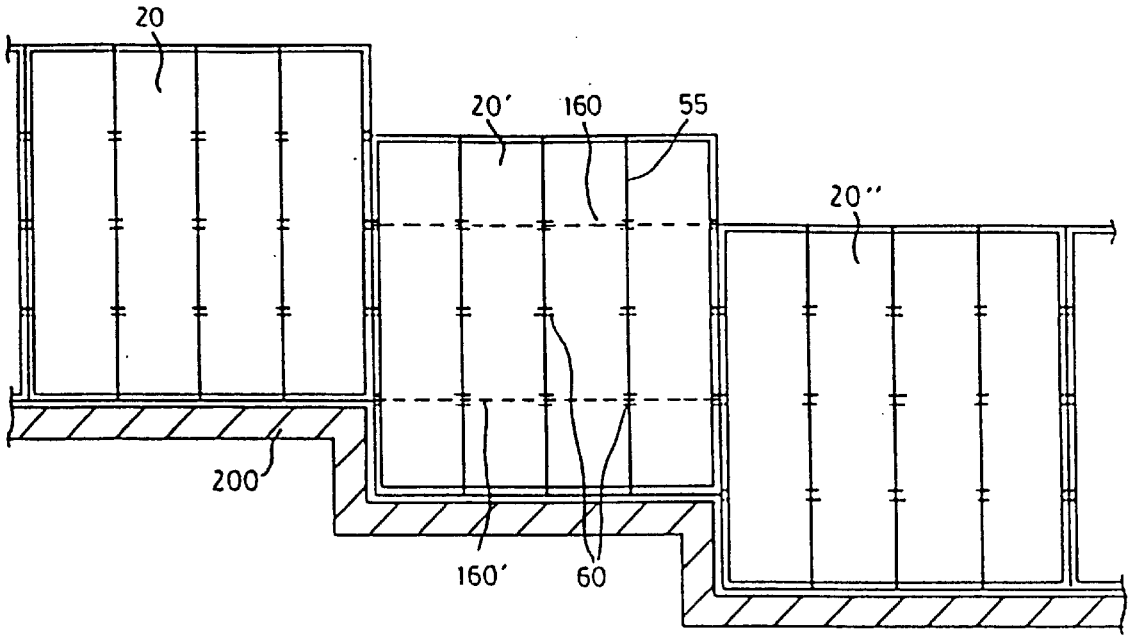
FIG. 11*a* is a front elevation of a series building panels of the invention connected together.

An example of the use of the tension belts is shown in FIG. 11*a* . In this example, three building panels (20, 20', 20") are connected to form a continuous wall that is stepped down an incline. The panels are shown resting on a concrete footing 200. It is preferred that in such an arrangement, the panels are stepped so that the top of the lower panel is at the same height as aperture 60 in the adjacent higher panel. This facilitates connection of the panels, as the apertures in adjacent end panels will align. The tensioning belt 160 which runs around the top beam of building panel 20" may be connected to the adjacent end rib of building panel 20' or, as shown, may be connected across building panel 20' and be secured to the closest end rib of building panel 20. Similarly, the tensioning belt 160' which runs around the bottom beam of building panel 20 may be connected to the adjacent end rib of building panel 20' or, as shown, may be connected across building panel 20' and be secured to the closest end rib of building panel 20". If the tensioning belts are connected as shown in FIG. 11*a*, the belts tie the plurality of panels together in a continuous string. In a preferred embodiment, all the panels that form the perimeter of the building will be joined together with tensioning belts which will form a continuous loop around the entire building. In the stepped wall construction shown in FIG 11*a*, the wall may be built to a desired level by attaching smaller panels to the top of panels 20' and 20" or by using convention brick or block construction.

Figure 11B:
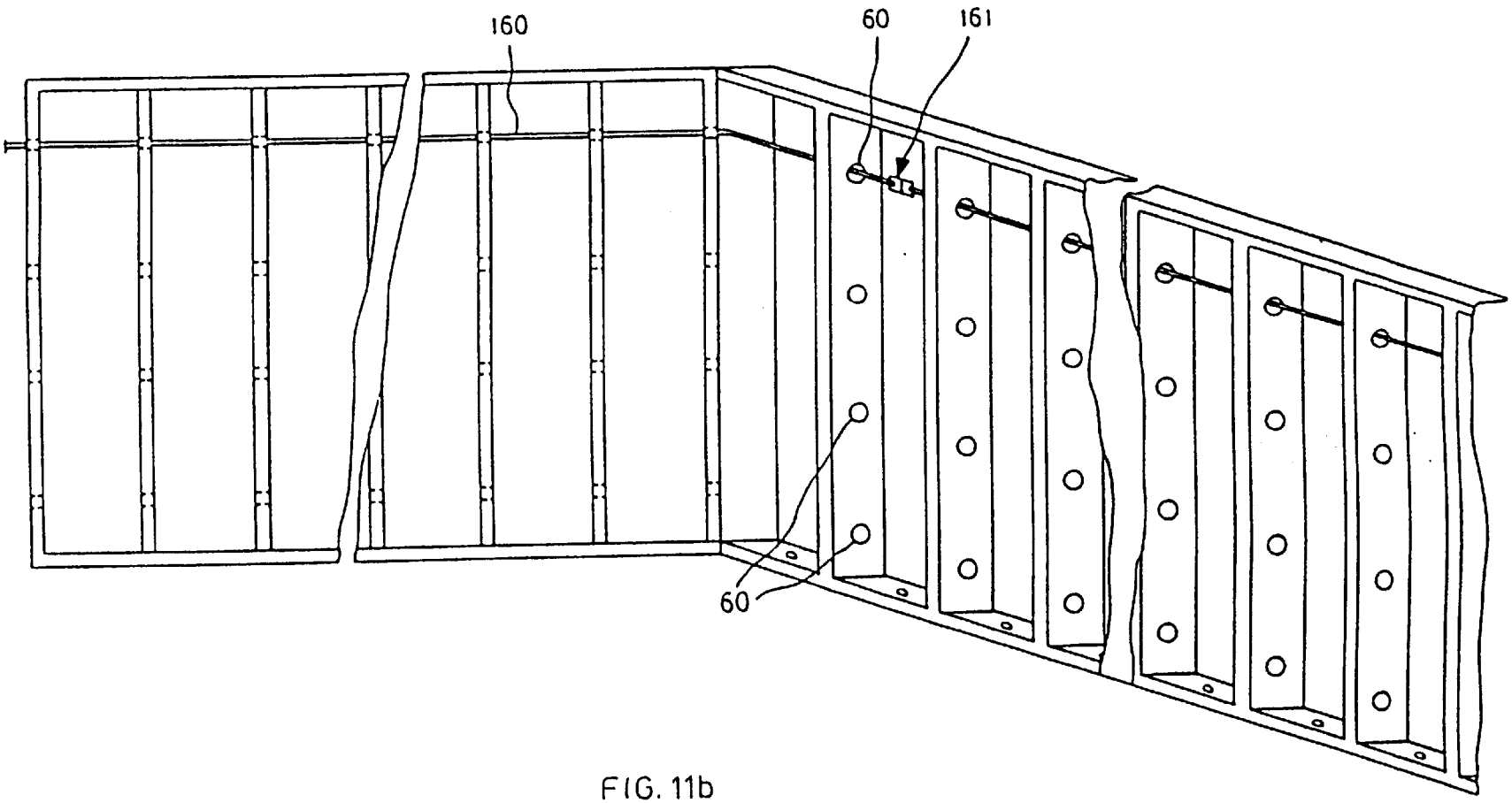
FIG. 11*b* is a perspective view of a panel attachment means according to another embodiment.

FIG. 11*b* illustrates another embodiment for attaching adjacent panels using a belt system. In this embodiment, a belt 160 extends through apertures 60 in the ribs of the panels and forms a continuous loop. A turnbuckle 161 is provided at given locations and is used to tighten the tensioning belt 160. Preferably, the belt 160 is capable of stretching.

It will be understood that the need for tensioning belts 160 described above are an optional item and serve to provide an added securing means for the panels over the bolts (described below) connecting adjacent panels. Such belts may only be required where the panels are placed on irregular footings.

Figure 12:
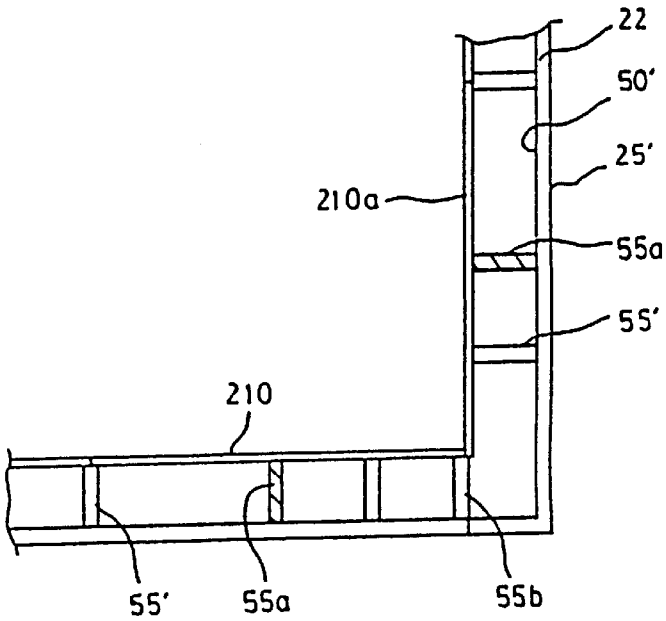
FIG. 12 is a cross-sectional plan view of an external corner building panel.

Thus far, the building panels of the present invention have been described with reference to constructing a linear wall. However, building panels in accordance with the present invention may also form or be used to form both internal and external corners. FIG. 12 shows a schematic representation of an external corner formed from a single corner panel. Similar to the previously described panel the corner panel has a front or external face 25' and an inside face 50'. Vertical ribs 55' extend inwardly from inside face 50'. As discussed above, it is preferable that the vertical ribs should be spaced no more than 2' apart. Another embodiment of a panel designed for an exterior corner is shown and discussed below in relation to FIGS. 33*a* and *b*.

Another consideration is in respect to the attachment of drywall to the inside of the corner panel. Drywall sheets 210 and 210*a* are preferably attached across the ends of ribs 55'. Drywall sheets are conventionally 4' wide and it is preferred that the sheets do not have to be cut prior to installation. Accordingly, "extra" ribs 55*a* may be included to act as support for the drywall. The "extra" ribs are provided 2' from the internal apex "P" of the external corner. The remaining ribs along the length of the wall can be spaced at 2' intervals from this "extra" rib.

Figure 13:
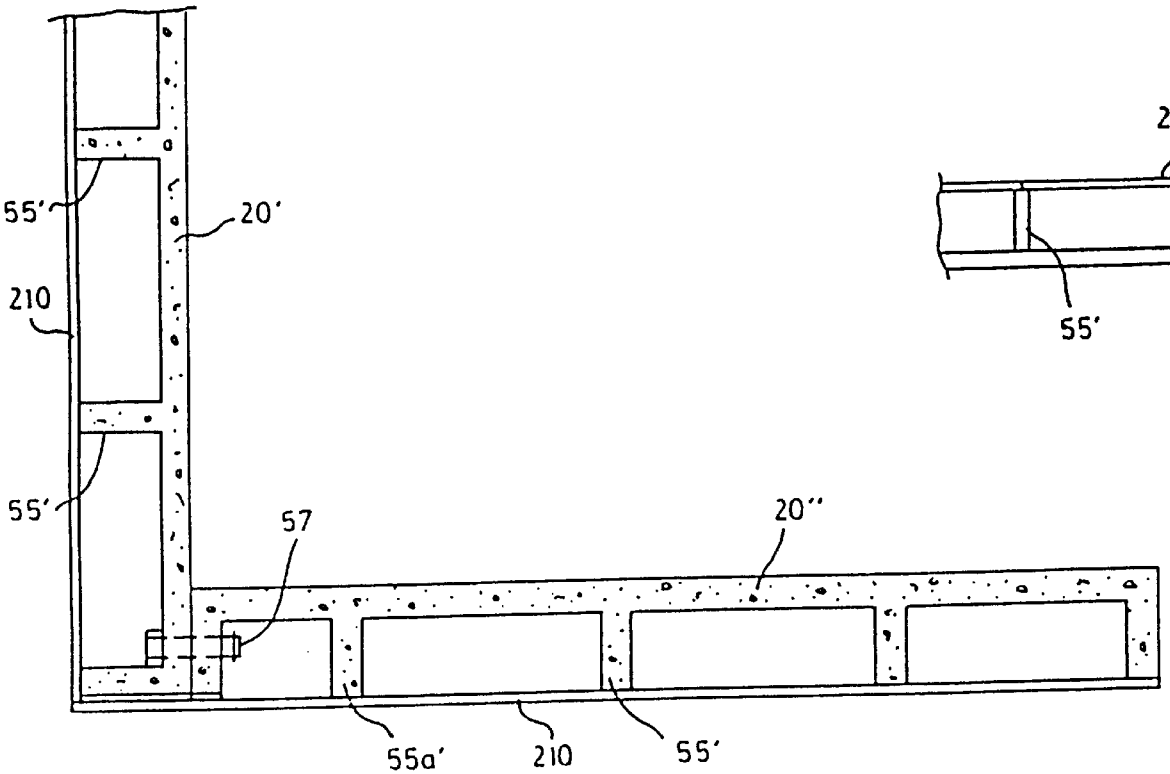
FIG. 13 is a cross-sectional plan view of an internal corner formed from two building panels.
Figure 15:
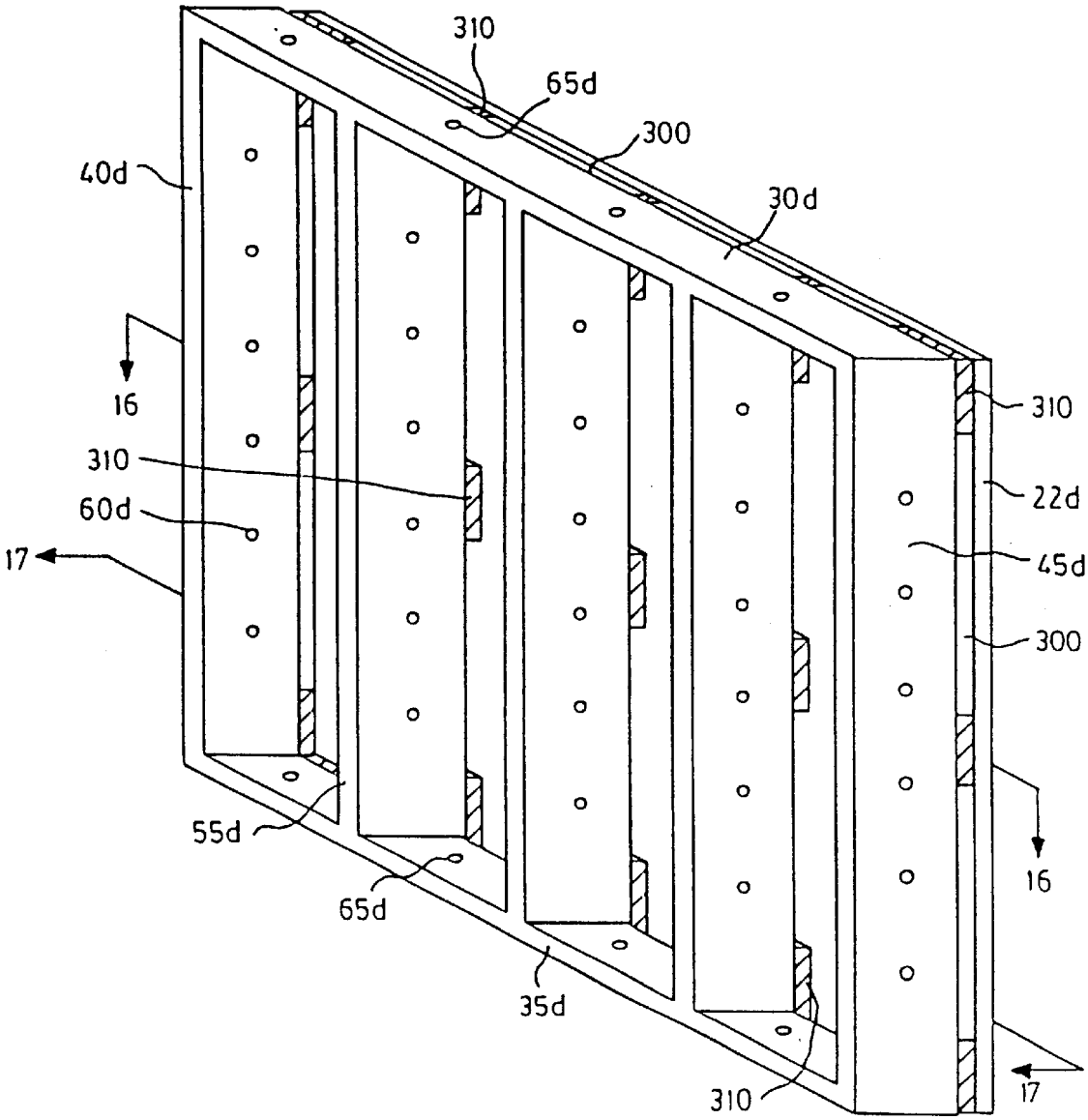
FIG. 15 is a perspective view of a building panel in accordance with a second embodiment of the present invention.
Figure 16:
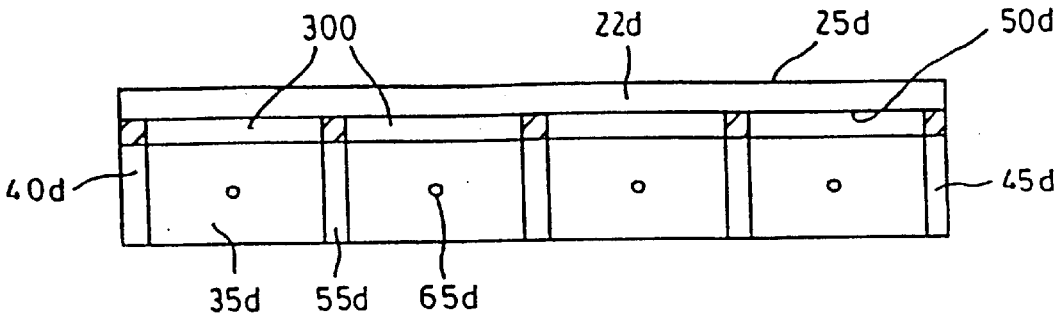
FIG. 16 is a plan section of the panel of FIG. 15, along the line 16—16.
Figure 17:
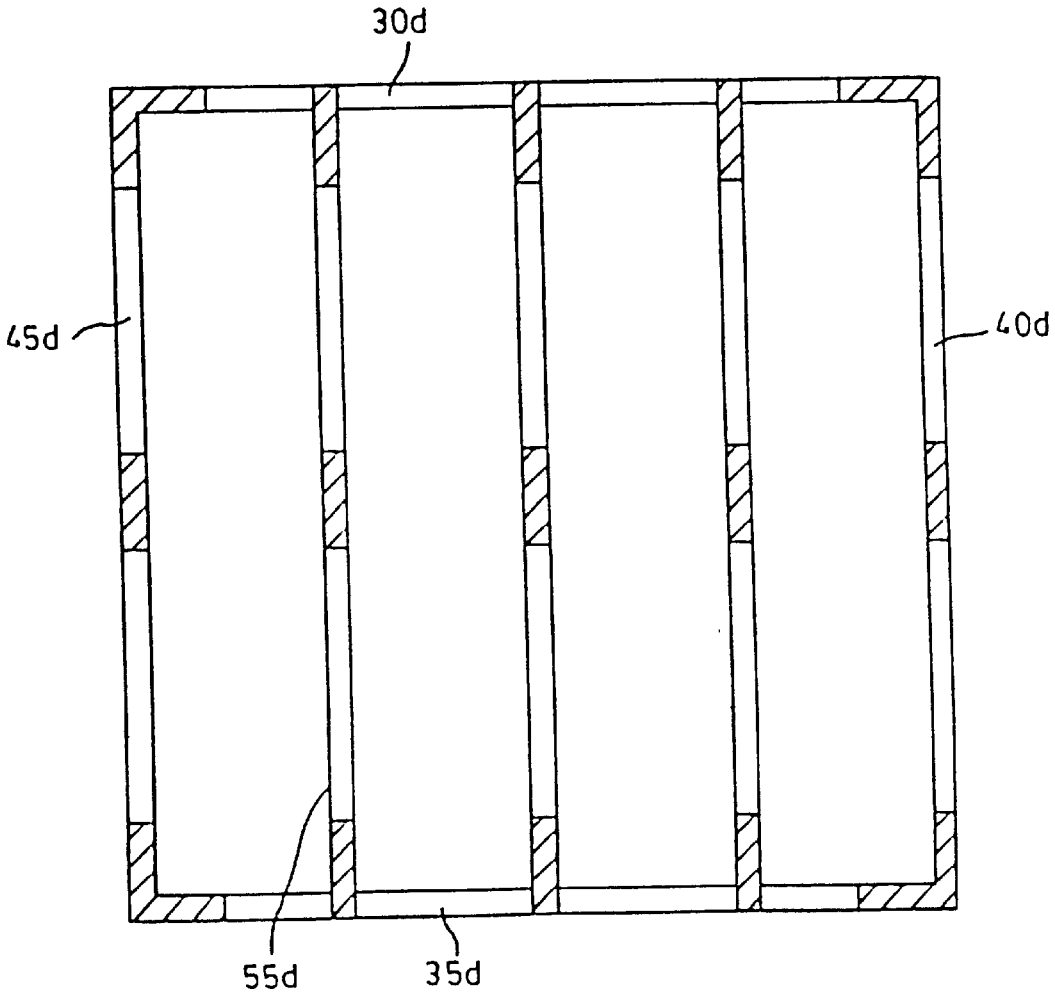
FIG. 17 is a side elevation of the panel of FIG. 15 along the line 17—17.

An internal corner formed from two building panels is shown in FIG. 13. Building panel 20' is a standard panel as described above, with the ribs 55' being equally spaced (2' apart) along its length. Panel 20" has an "extra" rib 55*a*' spaced such that it is 2' from the external apex "Q" of the internal corner. Thus, once again the ribs are provided no more than 2' apart and the "extra" rib permits drywall panels, 210, to be attached without cutting the 4' width.

As will be apparent when comparing the configurations of the external and internal corners shown in FIGS. 12, 13, and 33*a* and *b*, an external corner may also be formed from a pair of building panels connected in a similar manner to that described for the internal corner. Alteratively, a single-piece interior or exterior corner panel may also be formed. In such case, the corner panel would be a unitary structure that includes the corner section.

FIG. 13 also illustrates a pipe bolt 57, which are used to connect adjacent panels. The bolts 57 is passed through the apertures 60, described above, of the adjacent panels and tightened. By using a plurality of such bolts 57, the panels are connected together to form a continuous wall. The pipe bolts 57 are preferably hollow thereby allowing the apertures to still be used as a conduit for passing electrical wire etc.

Figure 14:
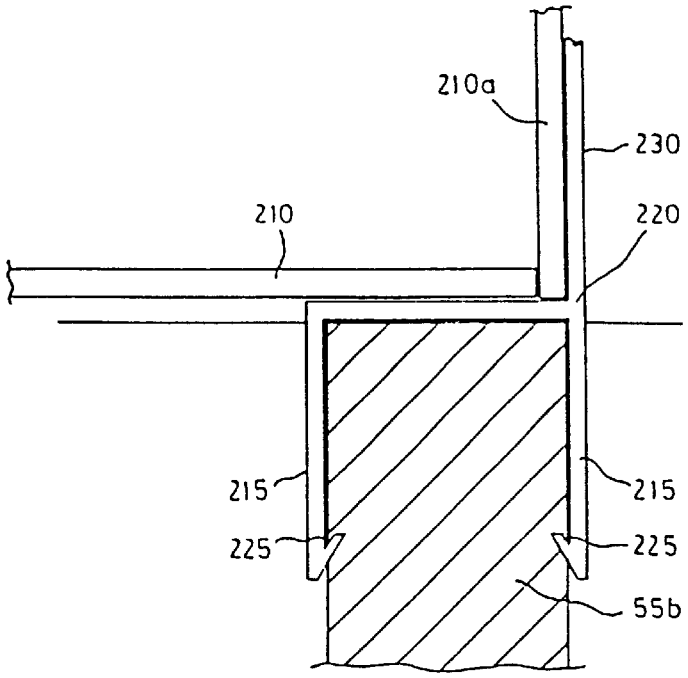
FIG. 14 is a plan view of a drywall connector for use with the building panels of the present invention.

FIG. 14 shows an enlarged cross-section of internal apex "P" of the external corner shown in FIG. 12. As will be apparent, drywall panel 210 may be attached to the end of rib 55*b* using conventional methods. However, in order to provide support for the attachment of drywall panel 210*a*, rib 55*b* may be provided with a clip 220. Clip 220 has a pair of depending legs 215 each of which have, at their distal ends, barbs which facilitate attachment of clip 220 to rib 55*b*. Web 230 extends perpendicularly to the face of rib 55*b* and to drywall panel 210, to provide a body to which drywall panel 210*a* may be attached. Clip 220 is preferably formed from high tensile steel.

With regard to the attachment of drywall to the concrete ribs, conventional fastening means, including adhesive may be employed. Alternatively, if desired, wooden strips may be attached to the outer surface of the ribs, to form a surface suitable to attaching the drywall. These wooden strips can, if desired, be formed integral with the ribs when the concrete for the ribs is first poured.

An alternative embodiment of the wall panel is shown in FIGS. 15–18, and 26*b* with like numerals referring to like parts with the suffix "d" added for clarity. This particular panel construction is useful in above-ground wall construction. In many jurisdictions the building codes specify that external above-ground walls must provide an air gap between outer and inner skins of the wall. The air gap acts as both an insulating layer and a barrier to help prevent water permeating between the exterior to the interior surface to the wall. The panel (referred to henceforth as the "air gap panel") shown in FIGS. 15–18 has a continuous air gap 300 between the inside face 50*d* of slab 22*d* and the top beam 30*d*, the bottom beam 35*d*, the end ribs 40*d* and 45*d* and the ribs 55*d*.

The actual continuous air gap is formed between the inside face 50*d* of the slab 22*d* and a plywood sheet 315 which extends between the ribs and is spaced from the inside face by the insulated connector. The plywood sheeting is generally inserted into the panel during formation by supporting the sheeting on the insulating connector or fastening it to the rebars prior to casting the ribs and end panels. Alternatively, it is envisioned that the plywood sheeting may be inserted into position within the panel structure after casting of the entire panel.

Figure 18:
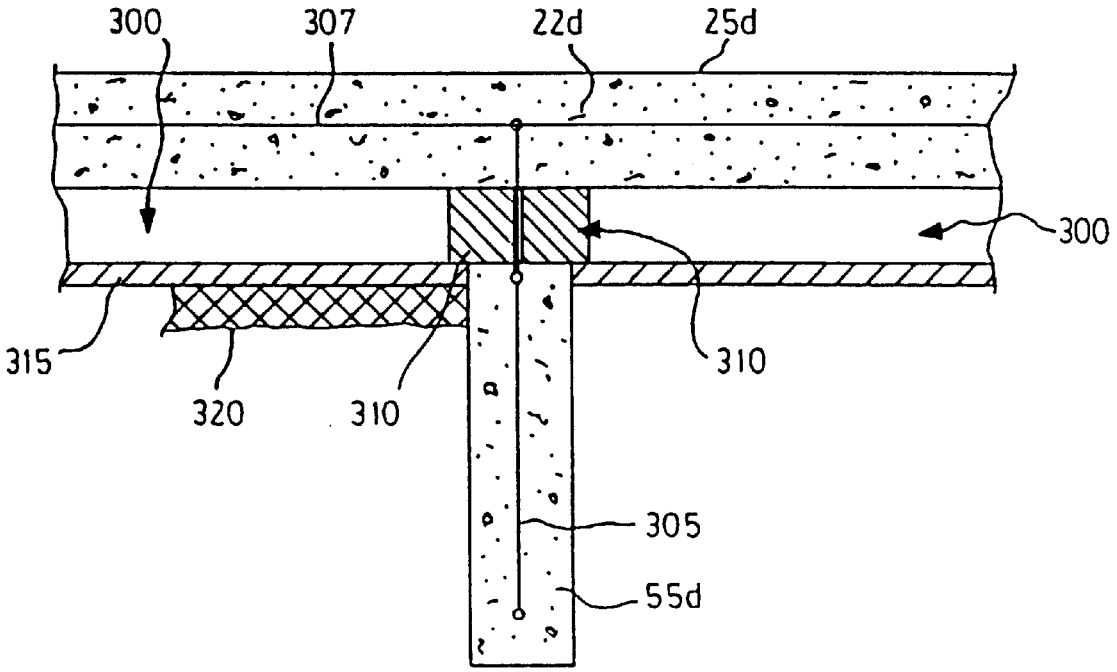
FIG. 18 is a cross-section of a rib attachment.

As shown in FIG. 18, the plywood sheeting may act a support for conventional insulation 320.

As shown in FIG. 18, the top and bottom beams and the ribs are connected to the slab by means of a reinforcement such as rebar 307, which may be integral with reinforcing mesh 307 provided in the slab or may be a separate element embedded in the slab material. The purpose of the reinforcement 305 is to establish a firm connection between the rib 55*f* and the slab 22*d*. However, the concrete portion of the beams and ribs are spaced from the inside face 50*d* by insulating connectors 310. The insulating connectors are generally spaced apart from one another to permit air flow within the air gap of individual panels and between air gaps in adjacent panels. One exception to this is when the entire perimeter of a panel is sealed as may occur if the panel is used in forming a basement wall or where two panels are joined at a corner.

In another embodiment, the insulating connectors may be provided in the form of continuous strips, which can later be drilled to provide air passages.

The insulating connector is preferably formed from a non-rusting, non-conductive structurally sound material such recycled plastic. An example of such a material is SAN-NOR Crete™, manufactured by Advanced Solutions . . . Advanced Technologies, Ontario, Canada.

The insulating connector not only helps provide structural integrity between the slab and the top and bottom beams and the ribs, but also acts as a protective cover over the connecting rebars to help prevent them from rusting. The insulating connectors are shown in the four corners of the panel as well as spaced along the length of the end panels and ribs. However, the exact positioning of the insulating connectors will depend primarily on the position of the interconnecting rebars 305.

The air-gap panel may be provided with knock-outs 60*d* to permit adjacent panels to be joined together with locking bolts or a tensioning belt, as described above with reference to the basement panel FIG. 19 shows a cross-section through a wall formed by a basement panel 20 and an air-gap panel 20*d* in accordance with the present invention. In this particular embodiment top beam 30 of the basement panel 20 is provided with an upstanding web of concrete 330 along its interior edge. The web 330 has a dual function; to help prevent ingress of water from the exterior of the building along joint 335 between the basement and air-gap panels; and to provide additional lateral stability to the bottom of the air-gap panel 20*d*.

Web 330 need not be formed integral with top beam 30 and may in fact be added later. The web may be formed of concrete or any other conventional building material such as brick or wood.

The web may provide part of the support for the floor structure 340. The basement panel and the air-gap panel may be secured together by locking bolts (not shown) which pass through the knock-outs provided in the top beam of the basement panel and the bottom beam of the air-gap panel.

Top beam 30 of the basement panel may be provided with levelling bolts (not shown) to facilitate alignment of the air-gap panel. The role of the levelling bolts is the same as described above with respect to the footings. Alternatively, the levelling bolts may be incorporated into bottom panel 35*d* of the air-gap panel. The levelling bolts also function as spacers between the two panels to help prevent mortar from being squeezed out of the joint due to the weight of the air-gap panel.

Figure 20:
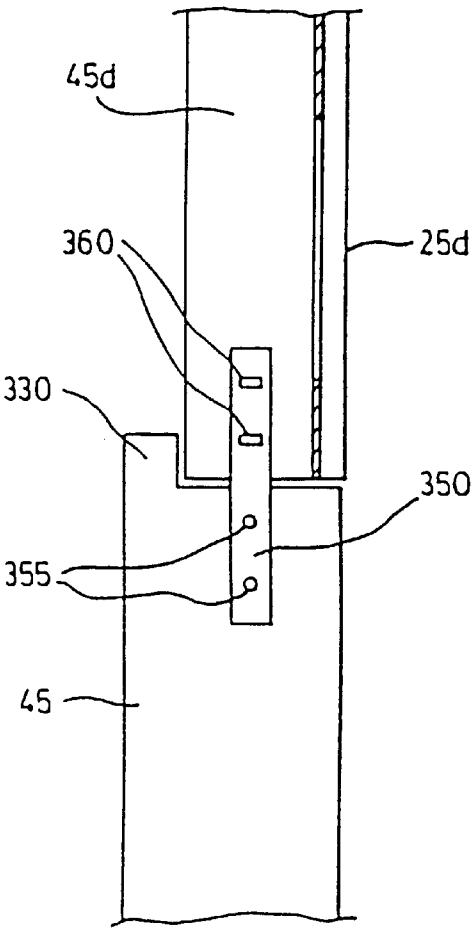
FIG. 20 is a side elevation of a panel connector.

An alternative technique for joining the basement and air-gap panels is shown in FIG. 20. In this technique a steel strap 350 is attached across the end ribs 45 and 45*d* of the basement and air-gap panels, respectively. The steel strap has a pair of holes 355 in the basement panel attachment end to receive fastening bolts and a pair of slots 360 in the air-gap panel attachment end. The pair of slots is adapted to receive fastening bolts in a manner which permits a small amount of adjustment so the builder can compensate for slight misalignment of the panels. As will be apparent to a skilled worker, the relative positions of the holes and slots may be reversed. Further description of the strap 350 is provided in the discussion relating to FIG. 31 below.

It is envisioned that the steel connector may be recessed into the end ribs of the basement and air-gap panels so that the thickness of the connector does not prevent abutment between the end panels of adjacent building panels. In a preferred embodiment the steel connector is approximately 4'×4"×0.5", with the holes and slots aligning with the knock-outs in the end panels of the building panels being joined.

As an alternative to having a recess for receiving the steel connectors, a groove may be formed along the entire length of end ribs 45 and 45*d*. This groove can receive the steel connector and may also be filled with a concrete adhesive/sealant, which will facilitate the attachment and sealing of two adjacent panels.

Figure 21:
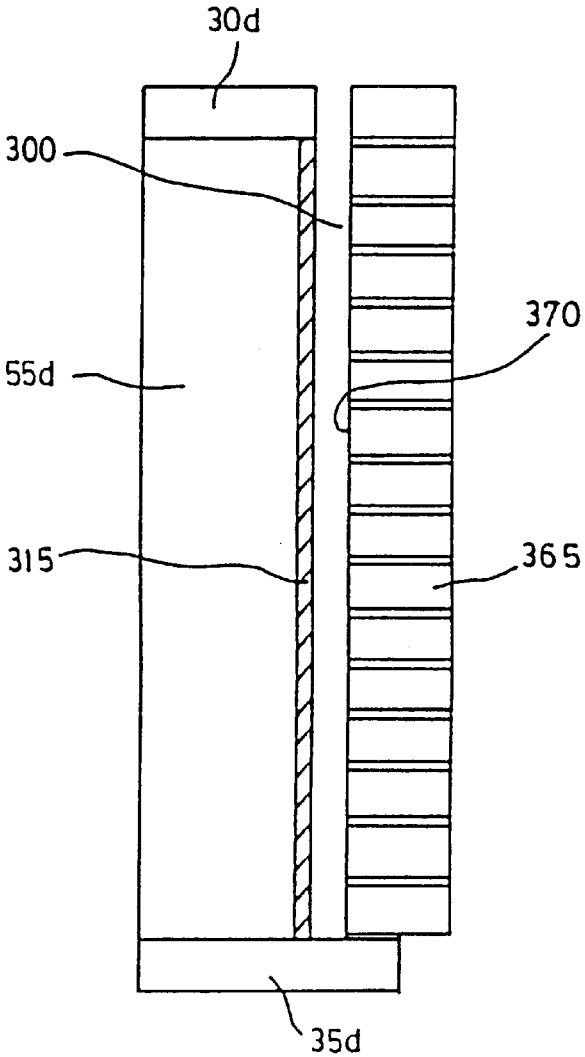
FIG. 21 is a side elevation of a building panel in accordance with yet another embodiment of the present invention.

A second embodiment of an air-gap panel is shown in cross-section in FIG. 21. In this embodiment the reinforced concrete slab is replaced with a brick fascia 365. The air gap is formed between the inside surface 370 of the bricks and a plywood sheeting 315. In this particular embodiment, bottom beam 35*d* is extended outwardly to provide a support for the bricks. The type of brick is not particularly limited and the choice of a suitable brick is within the purview of a person of skill in the art. The brick fascia 365 provides both structural integrity to the wall and provides an aesthetic value. As will be apparent, the brick fascia 365 may not cover the entire height of the panel. For example, the bottom half of the slab may be formed from concrete, with only the top half being formed of brick. Further, if desired, a brick fascia may be incorporated into a basement panel when a portion of the panel is to be above ground.

In an alternative embodiment, the brick fascia may be supported on the top beam of a lower building panel as opposed to resting on bottom beam 35*d*. Further, the top of the brick fascia may engage with top beam 30*d* in a manner similar to that shown in FIG. 21 with respect to the engagement of the brick fascia and bottom beam 35*d*.

Figure 22:
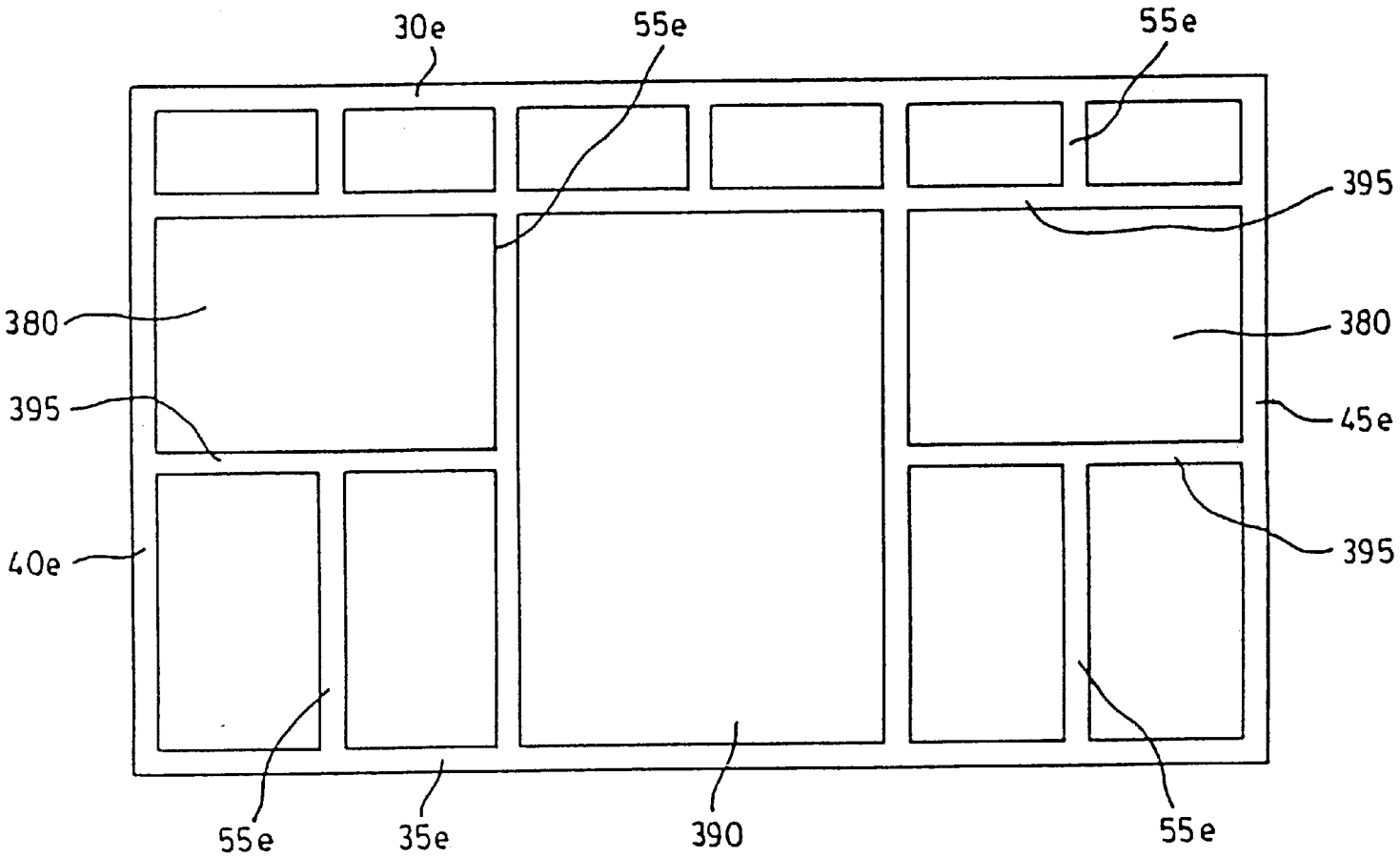
FIG. 22 is a back elevation of a building panel in accordance with a third embodiment of the present invention.

FIG. 22 shows a third embodiment of a building panel in accordance with the invention, with like numerals referring to like parts with an "e" added for clarity. This particular panel is provided with a plurality of apertures for forming windows 380 and a door 390. To maintain structural integrity in the panel, ribs 55*e* are supplemented with transverse ribs 395. The ribs 55*e* and 395 together define the frame for the windows 380 and the door 390.

All the panels described above may be connected directly together using the fastening systems discussed such that concrete-to-concrete joints are formed. However, it is envisioned that energy-absorbing flexible material may be incorporated into some or all of the panel-to-panel joints. Suitable energy absorbing materials may include, for example, rubber and other resilient polymers. Further, the panels may be connected using spring bolts, which permit a slight degree of movement between the panels. The use of energy-absorbing spaces and/or spring bolts will help make the building resistant to earth tremors and the vibration associated with earthquakes and severe weather systems such as cyclones, hurricanes and tornadoes.

Thus far, the building panels have been described with reference to their use as wall panels. However, the panels can also be used as floor panels. The panels can be supported on any conventional floor support structure. The building panel may be laid horizontally with the slab 22 forming either the upper or lower surface, as required by the builder. The panel ribs can be used as support for the internal wiring and plumbing which generally runs under a floor.

Figure 23:
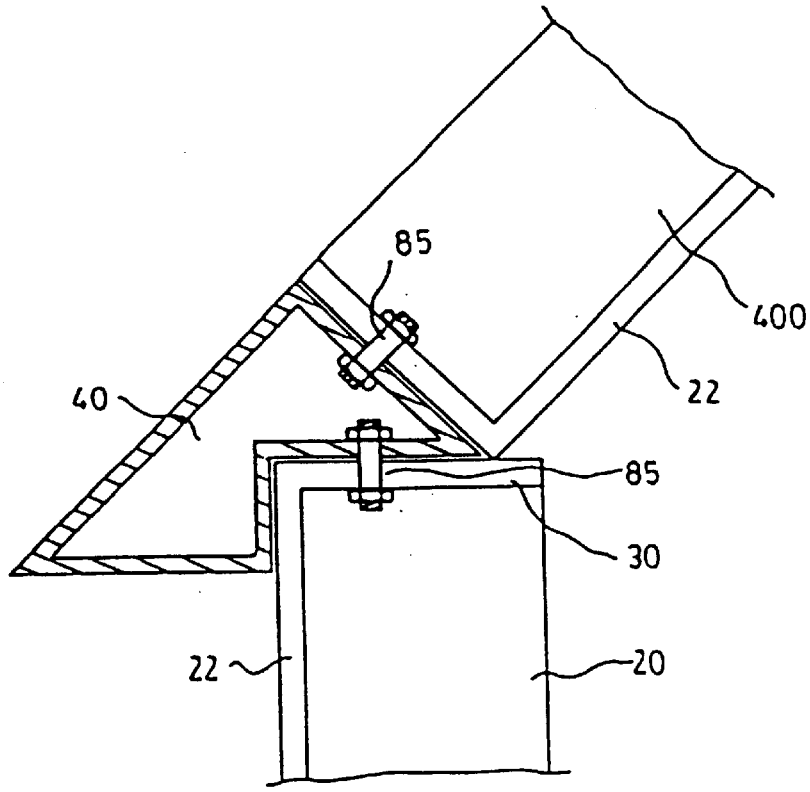
FIG. 23 is a sectional view of an eaves unit.

The building panels of the present invention may also be used in the construction of a roof for a building. A method of joining a sloped roof panel to a vertical wall panel is shown in FIG. 23. For safety reasons it is preferred for a corner of sloped roof panel 400 to rest on top beam 30 of the wall panel 20. The corner may be flattened to aid in weight distribution. The eaves of the roof are formed by a stepped eaves unit 410 which is also preferably formed of reinforced concrete but may also be formed from wood, plastic or the like. The eaves unit 410 is attached between the sloped roof panel 400 and the wall panel 20 by bolts 85.

In the embodiment shown in FIG. 23, sloped roof panel 400 is oriented such that slab 22 forms the lower (i.e., interior) surface of the roof. In this case, the outer skin of the roof may be formed across the ribs of the panel in any conventional manner. Alternatively, sloped roof panel 400 may be oriented such that slab 22 forms the upper (i.e., exterior) surface of the roof.

In yet another embodiment, eaves unit 410 may be formed integral with sloped roof panel 400, i.e., a specialized, pre-cast roof panel may be formed having at one end thereof the shape of the stepped eaves unit. This would simplify construction of a building as there would be fewer pieces to be bolted together.

The apex of the roof may be formed by an apex unit 420 attached between ends of adjacent sloped roof panels 400. Once again, the apex unit 420 is preferably formed from reinforced concrete and it is attached between the ends of the adjacent sloped roof panels by bolts 85. The apex unit may also be formed from a steel channel.

The angle of the roof may be modified by changing the angle θ of the apex unit. Further, if desired, the strength of the apex unit may be increased by reinforcing the interior of the unit with steel cross-member or poured concrete.

Figure 24:
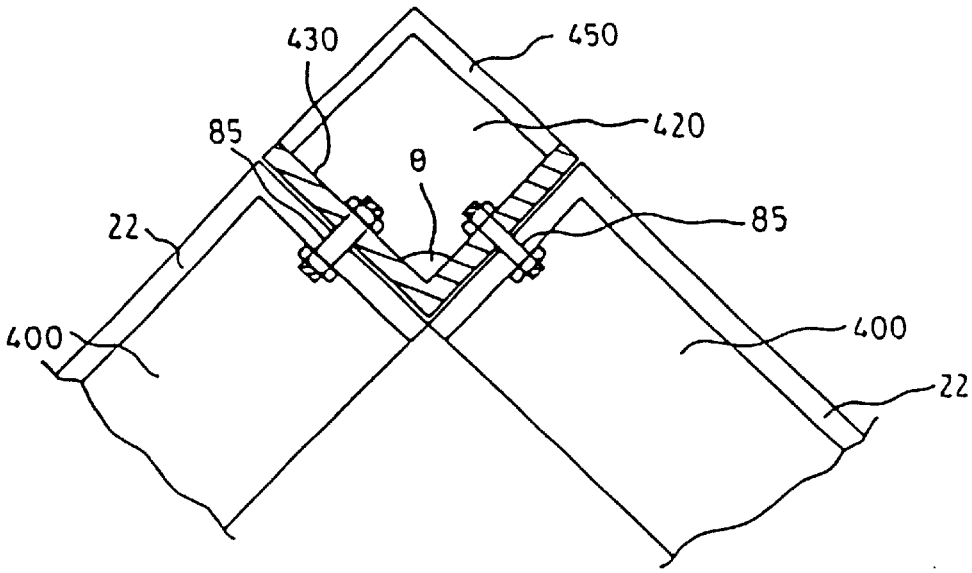
FIG. 24 is a sectional view of an apex unit.

As indicated in FIG. 24, apex unit 420 need not necessarily be formed as a concrete tube, but rather, the lower concrete V-shaped walls 430 and 440 may act as a support for a plywood cap 450. The plywood cap 450 may be treated in any conventional manner to form a secure, watertight seal between the sloped roof panels.

As discussed above with respect to the eaves units, the front panel 22 may form either the interior surface or the exterior surface of the roof, depending on the builder's preference.

Figure 25:
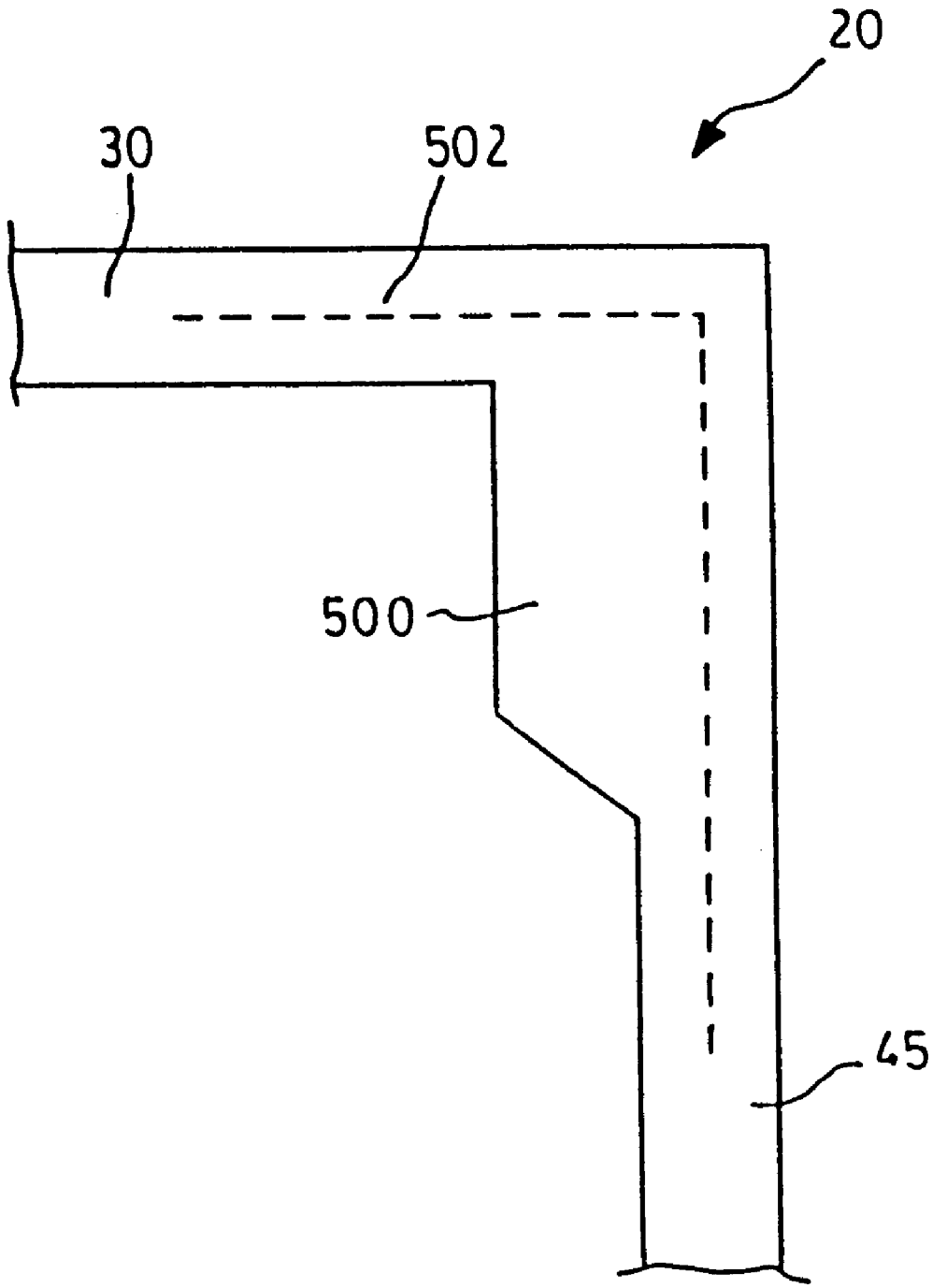
FIG. 25 is a partial front elevation of a panel according to another embodiment of the invention illustrating a reinforced corner portion.

In another embodiment of the building panel of the invention, as illustrated in FIG. 25, the end ribs 45, for example, are provided with reinforced portions 500 near the juncture with the top beam 22. This type or arrangement provides more reinforcement for joining adjacent panels. For further reinforcement, rebar 502 may also be provided in the corners of the panels 20. With reinforced portions 500, adjacent panels may be joined together via bolts extending through their respective top beams without the need for the tensioning belt discussed above. Additional support may be derived by connecting the panels with bolts extending between adjacent end ribs.

Figure 26B:
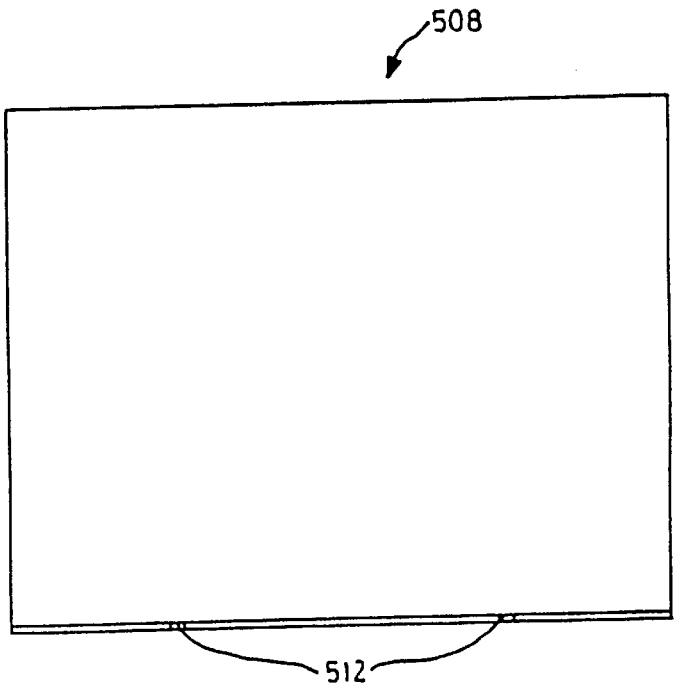
FIG. 26*b* is a rear elevation of the upper panel shown in FIG. 26*a*.
Figure 26A:
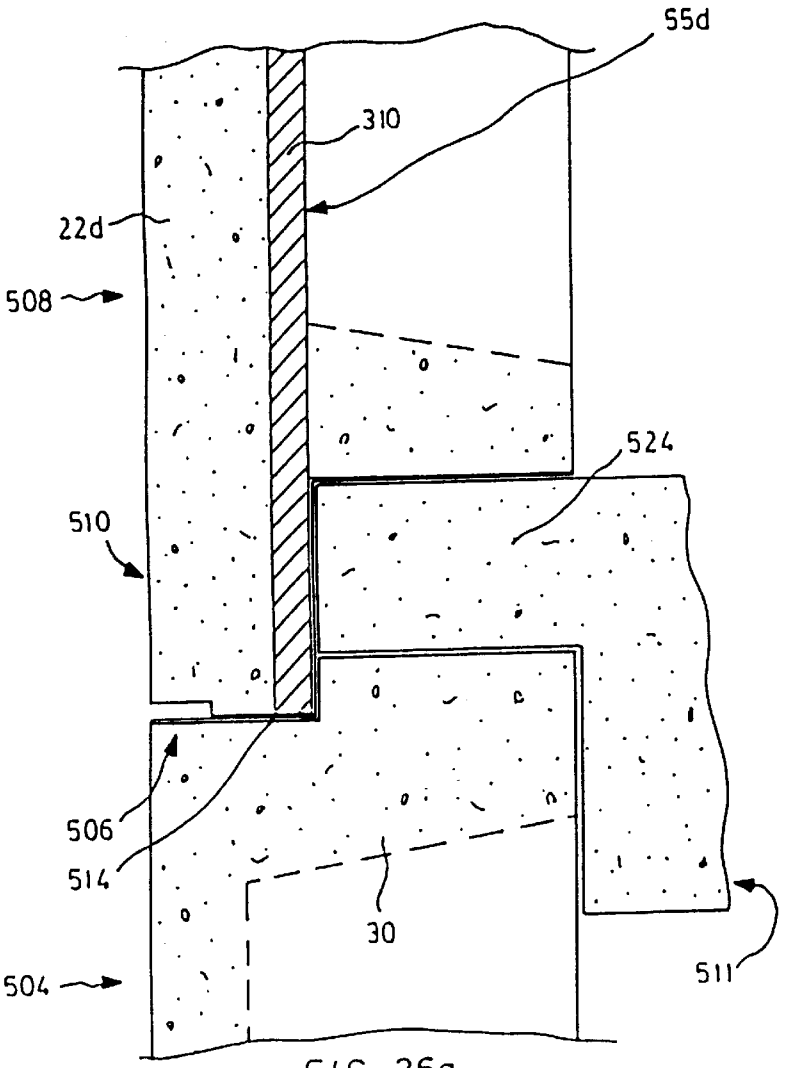
FIG. 26*a* is a side cross sectional elevation of a building wall comprising two stacked panels.

FIG. 26*a* shows a further embodiment of the invention illustrating one arrangement of panels for the basement and top floor. As shown, the basement panel 504 is provided with a recess 506 on the top beam 30 thereof. The top floor panel 508 includes an extension 510 in the slab 22 thereof. The extension 510 of the top floor panel is dimensioned to be inserted into the recess 506 of the basement panel 504 so as to provide a close fit. Also shown is a floor panel 511, which is described in more detail below.

As illustrated in FIG. 26*b*, the top floor panel is also provided with drainage holes 512 at two locations over its length to allow moisture to pass through. Preferably, the drainage holes 512 are provided 2 feet from each side of the panel thereby resulting in the holes being separated by 4 feet. The holes are also preferably ¼" in height and 1½" deep. The top floor panel 508 shown in this embodiment is similar in construction to the "air-gap" panel described above with the exception of the extension 510 being provided. To provide additional water tightness, a vapour barrier 514 may also be provided between the two panels.

Figure 26C:
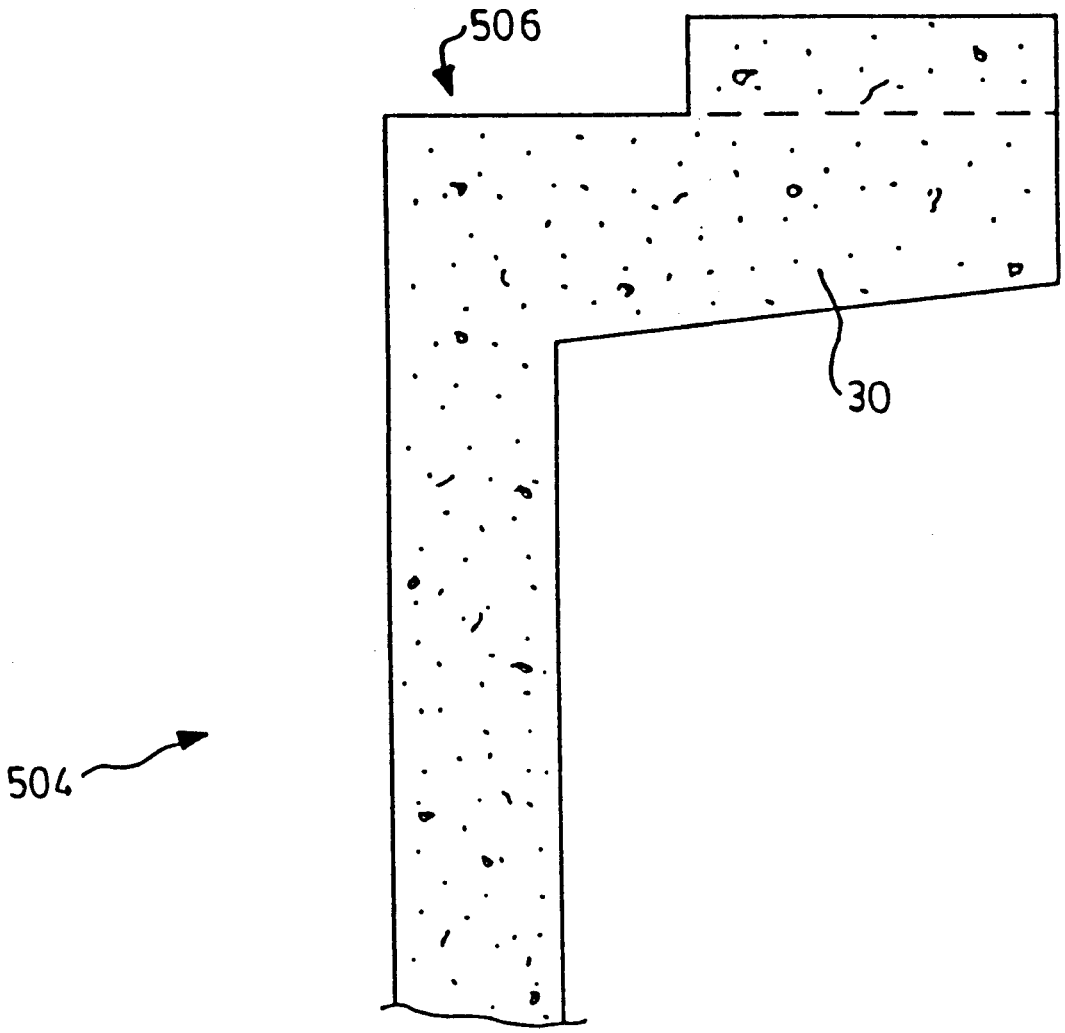
FIG. 26*c* is a side cross sectional view of the lower panel shown in FIG. 26*a*.

FIG. 26*c* more clearly illustrates the basement panel 504.

Figure 27A:
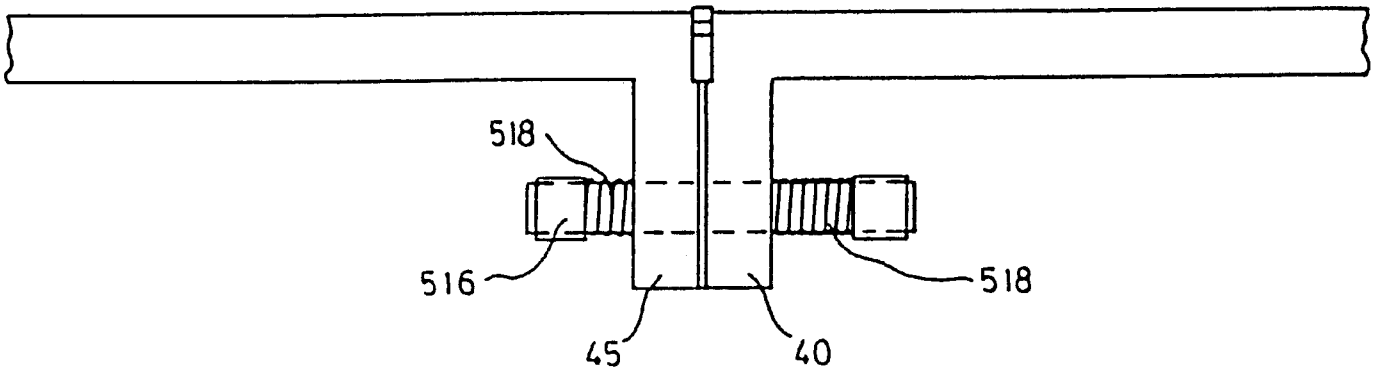
FIGS. 27*a* and 27*b* are top cross sectional views of different embodiments of joining adjacent wall panels.
Figure 27B:
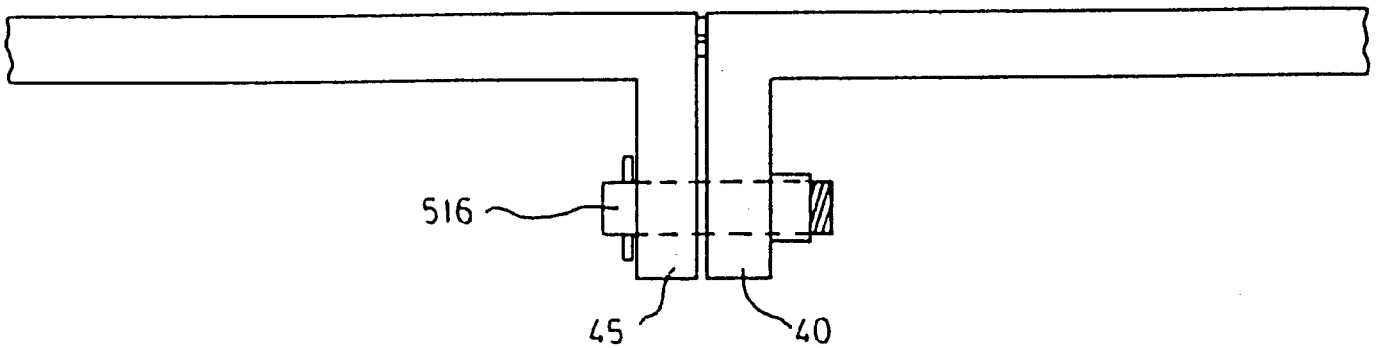

FIGS. 27*a* and 27*b* illustrate two means of connecting adjacent panels via adjacent end ribs. In FIG. 27*a*, a connection is shown that allows for expansion. In this case, the adjacent end ribs, 40 and 45, respectively, are connected by means of a pipe bolt and nut combination 516 that also includes springs 518 between the ribs and the bolt and nut. In this manner, any expansion or slight movement of the adjacent panels can be accommodated without any structural damage. In FIG. 27*b*, the connection between two adjacent panels is more rigid by means of a pipe bolt and nut combination 516 without the use of springs.

As mentioned above, the pipe bolts 516 are preferably hollow thereby allowing passage of electrical and plumbing etc., there-through.

Figure 28:
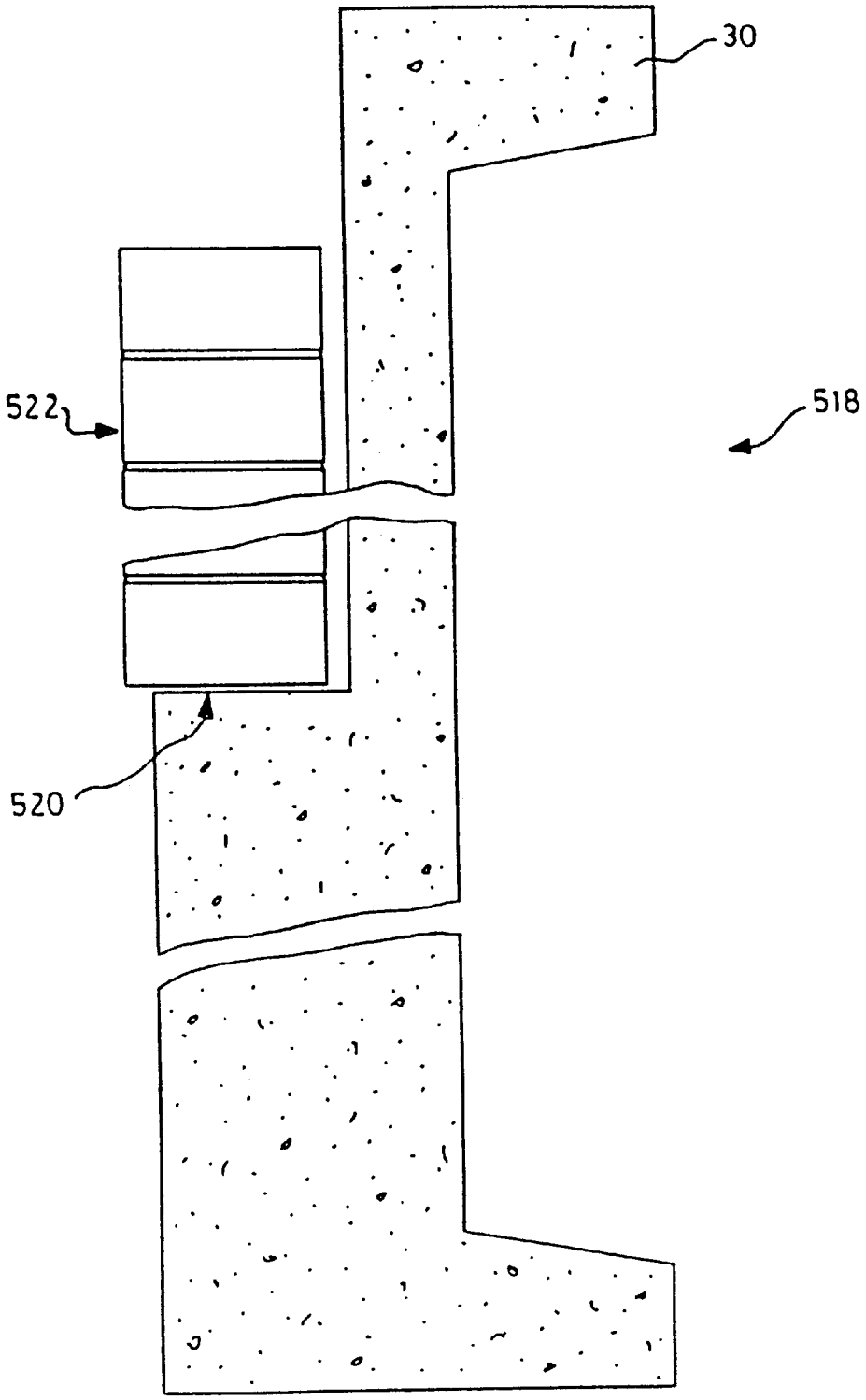
FIG. 28 is a side cross sectional elevation of another embodiment of the invention wherein a wall panel is designed to support an exterior veneer of brick.

FIG. 28 shows a basement panel according to another embodiment wherein the panel 518 is provided with a ledge 520 for supporting an exterior brick veneer 522.

Figure 29:
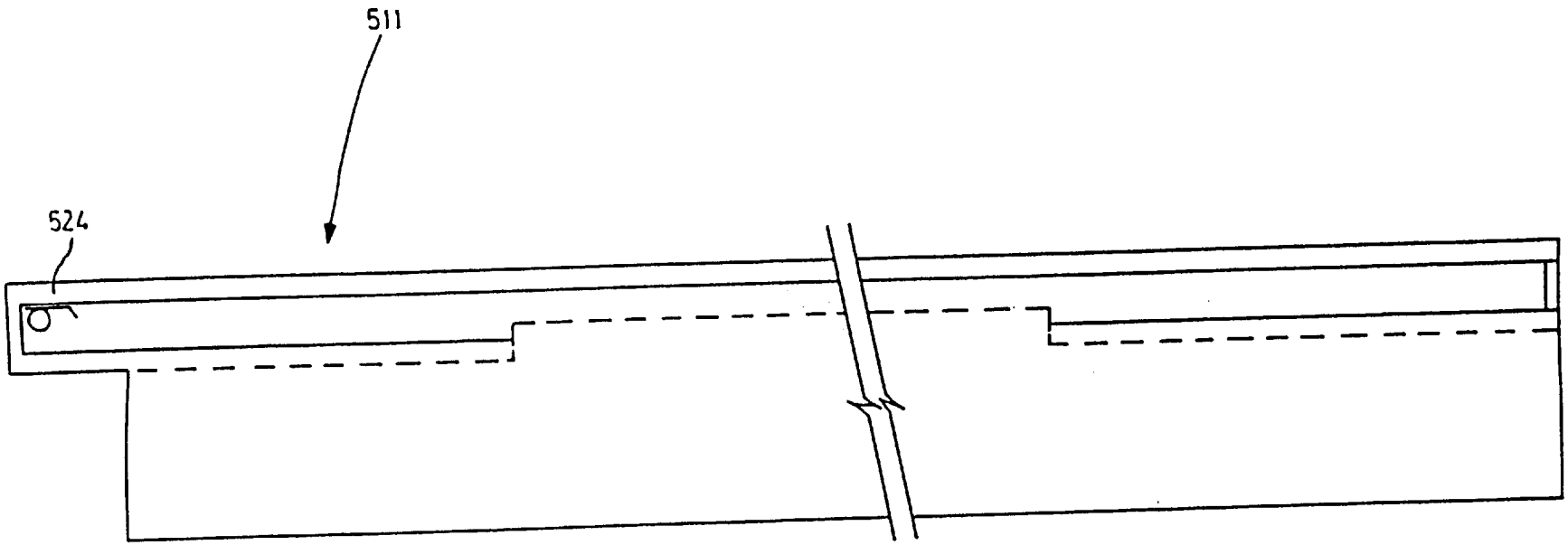
FIG. 29 is a side elevation of a panel of the invention according to another embodiment wherein the panel is used for flooring.

As shown in FIG. 26*a*, the panels of the present invention may also be used as floor panels 511. A more detailed illustration of such panel is shown in FIG. 29. The panel 511 is essentially of the same construction as the wall panels described above. The floor panel 511 may be provided with an extension 524 of the slab. The extension is then rested on the top beam of the basement wall panel to create a first floor for the building. If necessary, additional vertical support may be provided by means of pillars etc. as is conventionally known. The need for such additional support will, of course, depend upon the span of the floor.

The following description of FIG. 30 will use the same element numbering as for FIG. 26*a* to identify similar elements in the drawings.

Figure 30B:
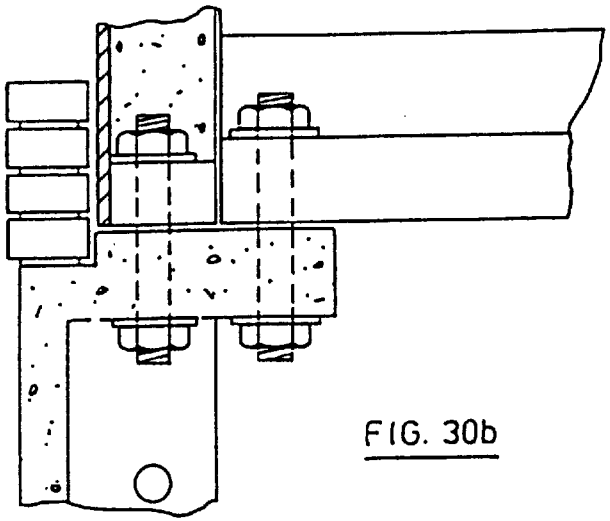
FIGS. 30*a* to 30*e* are side cross sectional elevations of various embodiments of the invention illustrating different arrangements of the wall and floor panels.
Figure 30C:
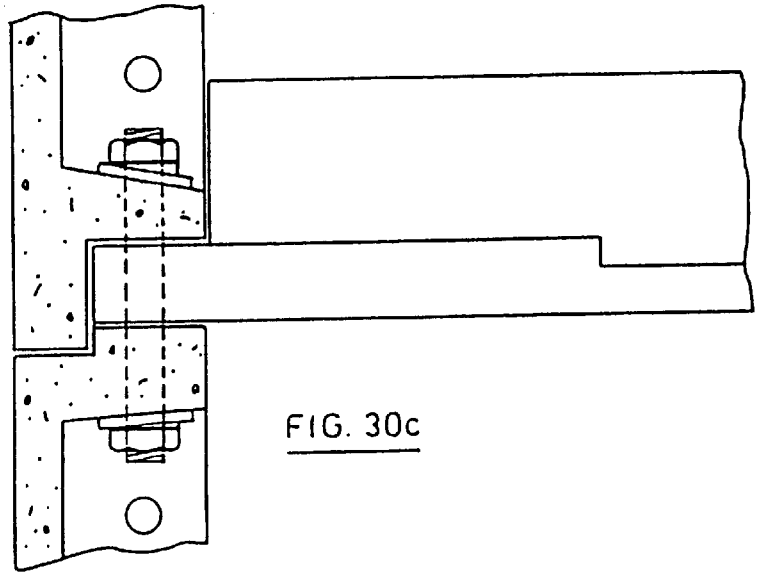
Figure 30A:
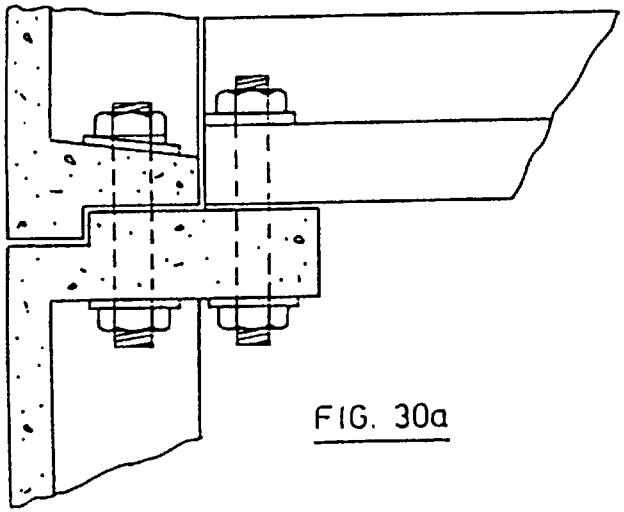

FIGS. 30*a* to 30*c* depict various other embodiments of the invention wherein the panels are used for flooring. As shown in these figures, the top floor panel, basement panel and floor panels are connected by means of bolts extending there-through. As shown in the figures, when used for flooring, the panels of the invention may be oriented in either direction. That is, for a flat concrete floor, the panels may be placed with the slab 22 facing upwards. In the alternative, the panel may be reversed so that the ribs are positioned upwards. In the latter case, the ribs function as joists over which standard flooring may be attached.

As described above, the present invention includes the use of the above panels for use in top floor walls and for flooring. However, it will be appreciated that any of these uses may be replaced with traditional methods of construction. For example, instead of using the panels for the top floor walls, it is possible to use typical wood stud construction wherein the typical walls are connected to the basement wall panels by known methods. Similarly, the floor system may comprise traditional wood joists extending over the top beams of the basement panels. Further, metal joists may also be used. In the latter case, the metal joists may be used to support flooring panels made that comprise the concrete panels of the present invention.

Figure 30E:
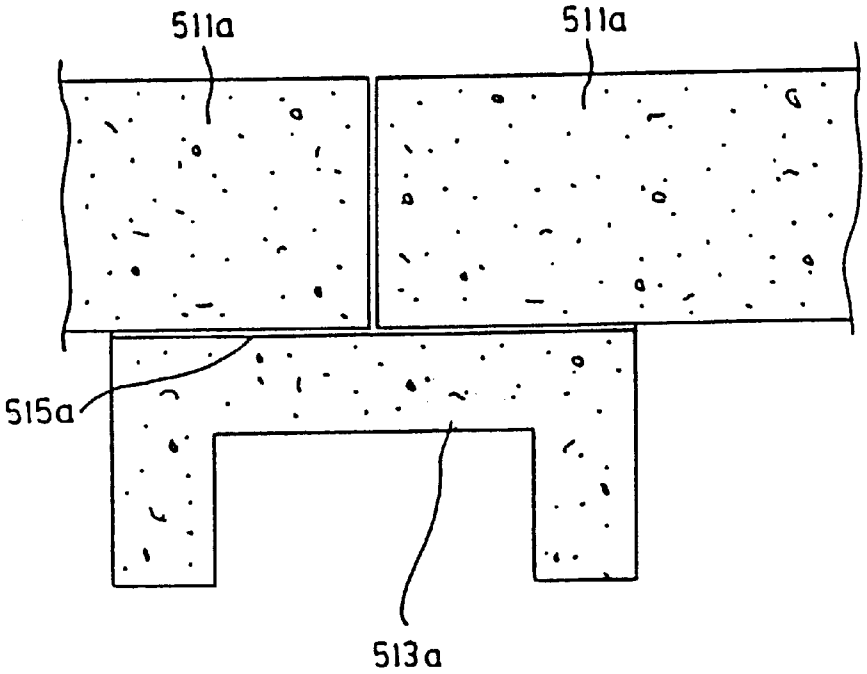
Figure 30D:
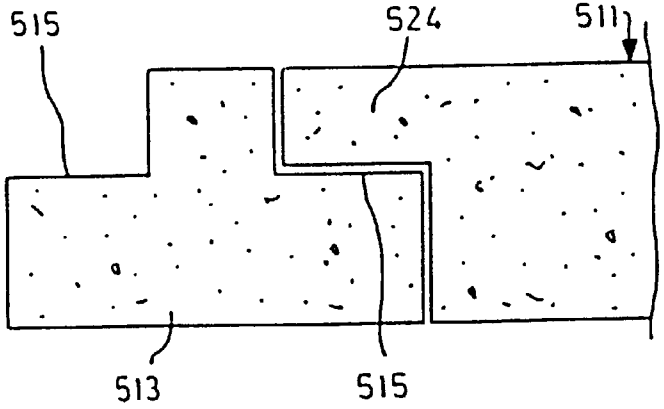

FIGS. 30*d* and 30*e* illustrate a further embodiment of the invention wherein beams are provided to support the panels when used for flooring. In FIG. 30*d*, one version of the beam is shown at 513. As shown, beam 513 includes a pair of ledges 515, which are designed to support the extension 524 of the floor panel 511.

FIG. 30*e* illustrates another embodiment wherein the letter "a" is used to identify elements that are similar in function. In this embodiment the beam 513*a* comprises an inverted "U" shaped structure that provides a single ledge 515*a* for supporting flooring panels 511*a*. In FIGS. 30*d* and 30*e*, the beams 513 and 513*a* extend over opposite vertical wall panels and provide a support surface for the floor panels. In this way, the floor panels can be installed without having to be directly resting on the wall panels.

Figure 31:
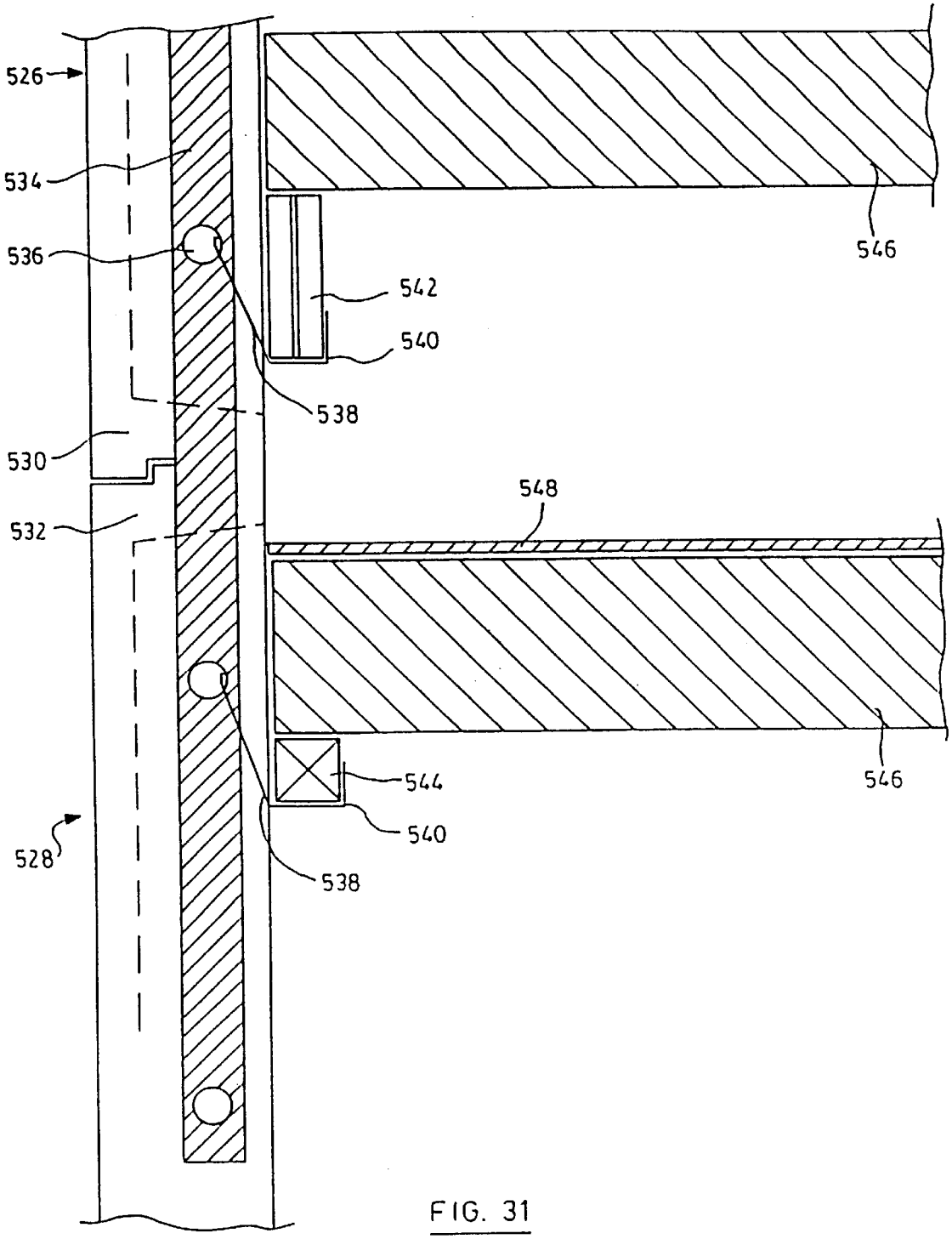
FIGS. 31 and 32 is a side cross sectional view of wall panels of the invention according to another embodiment wherein apertures in the panels are used to support flooring.
Figure 32:
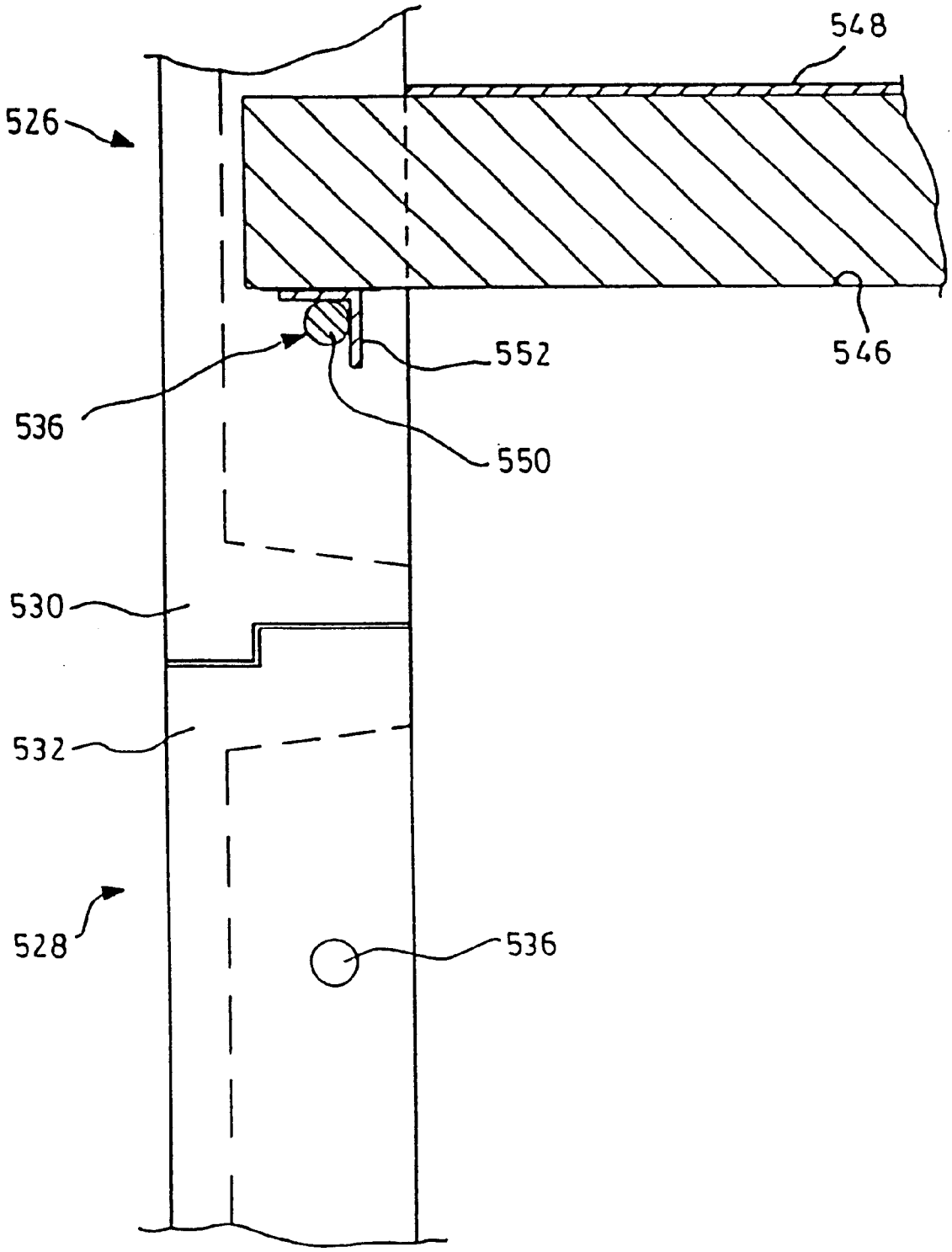

FIGS. 31 and 32 illustrate various embodiments wherein conventional flooring construction methods may be used with the panels of the present invention. In these figures, like elements are referred to with like reference numbers.

FIG. 31 illustrates a further embodiment of the invention wherein the panels of the invention are used to construct a building. In this embodiment, top and bottom panels 526 and 528, respectively, are connected together to form top and bottom levels of the building. As discussed before, the connection of the panels is achieved by conventional methods such as the use of bolts extending between the bottom beam 530 of the top panel 526 and the top beam 532 of the bottom panel 528. Also as discussed above, the connection between the panels is preferably reinforced by a connecting plate 534, which is bolted to both panels at the end ribs thereof. Such bolts extend through the apertures 60 provided in the ribs of each panel. In the preferred embodiment, a groove is provided in the end ribs to accommodate the connecting plate so that the two panels are in contact.

Referring again to FIG. 31, it is shown that the panels are provided with hangars 538. The hangers are designed, at one end, to engage the apertures 536 of the ribs on the panels and, at the opposite end, are provided with a hook 540. The hook 540 of the hanger 538 is adapted to receive 2×12 joist stringers 542 as are commonly known or 4×4 headers 544. In either case, conventional wood joists 546 can be attached to the stringers 542 or heads 544 as is commonly know. Following this, a typical plywood flooring 548 may be applied. In this manner, the level of the floors in a building can be adjusted to allow for a "sunken" effect where required.

In FIG. 32 another embodiment of an adjustable floor level is illustrated wherein a metal pipe 550 is inserted through the apertures 60 in the panels and a metal angle iron 552 is welded to the pipe. The angle iron 552 thus creates a header onto which conventional joists 546 can be attached.

Figure 33B:
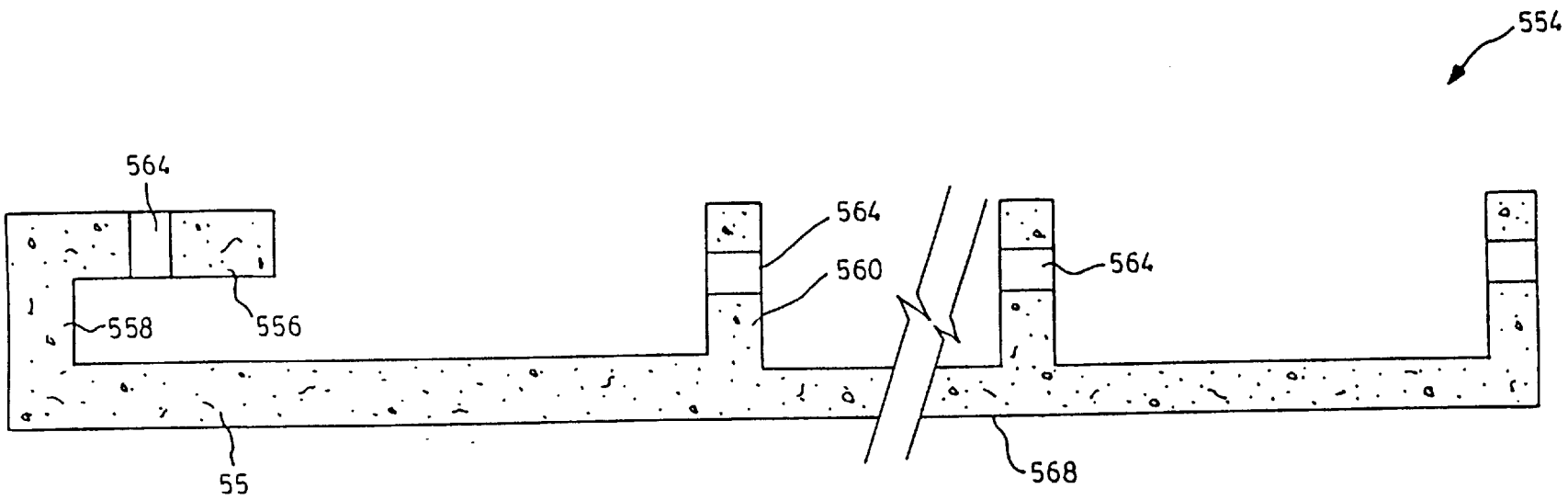
FIG. 33*b* is an end cross sectional view through the line A—A of FIG. 33*a*.
Figure 34B:
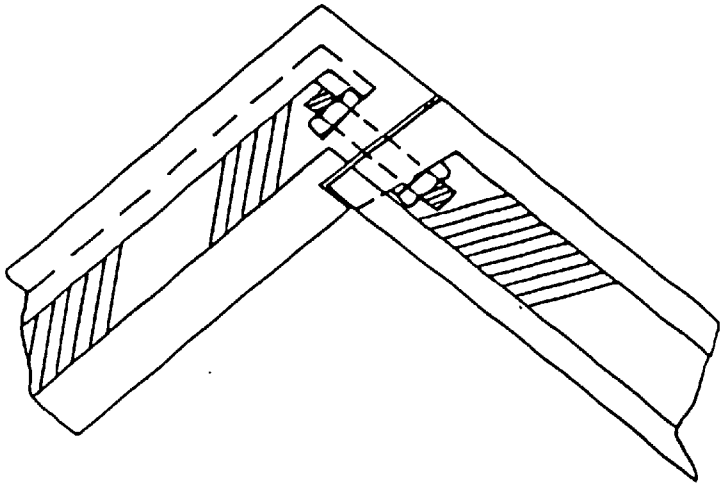
FIGS. 34(*a*) to 34(*l*) are side cross sectional views of further embodiments of the invention wherein concrete panels are used to construct a roof of a building.
Figure 34A:
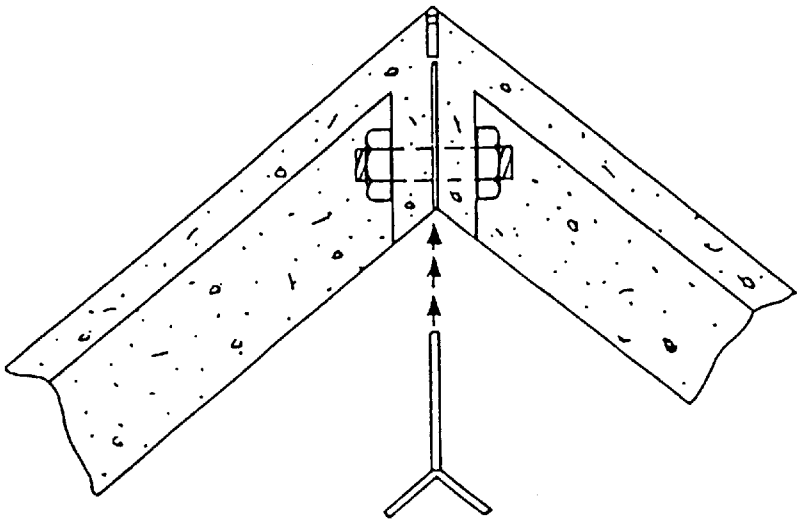
Figure 34C:
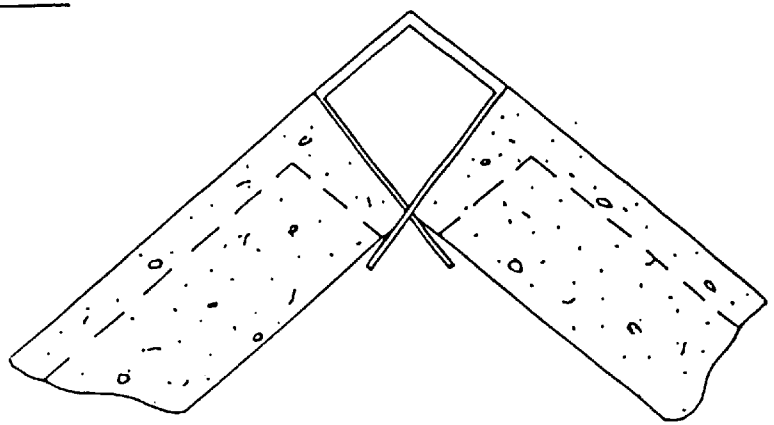
Figure 34E:
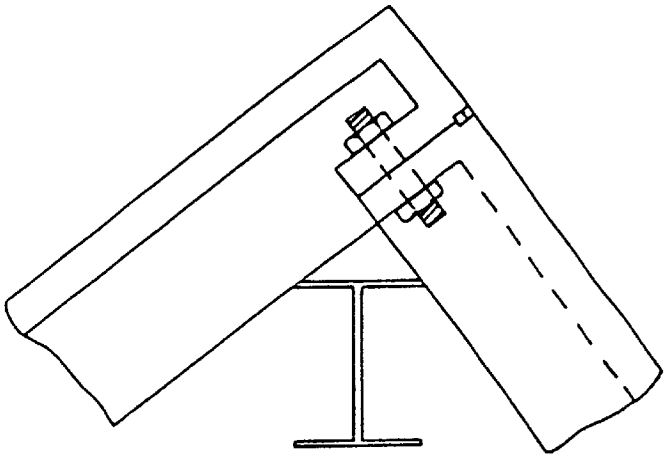
Figure 34F:
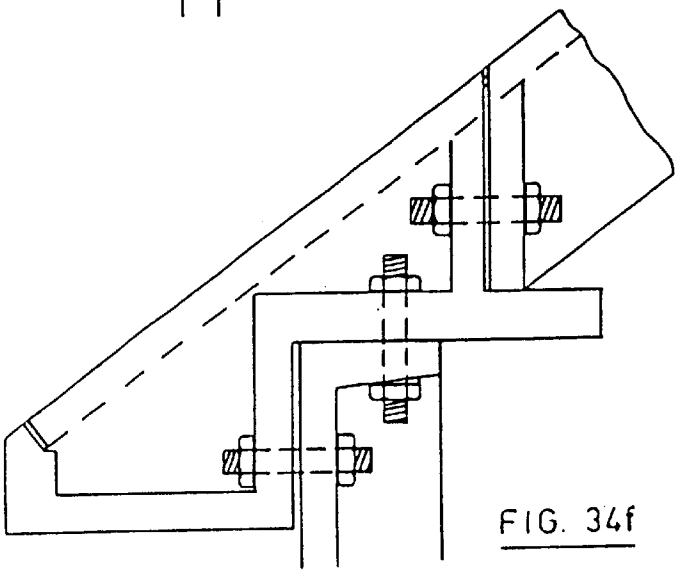
Figure 34D:
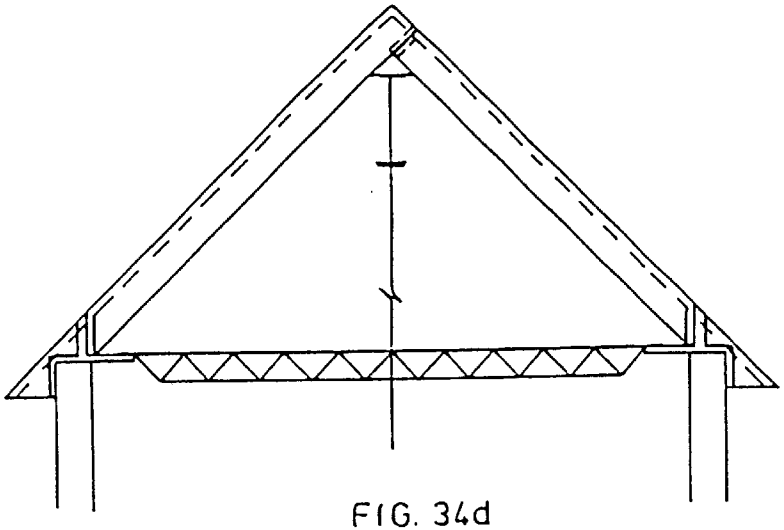
Figure 34H:
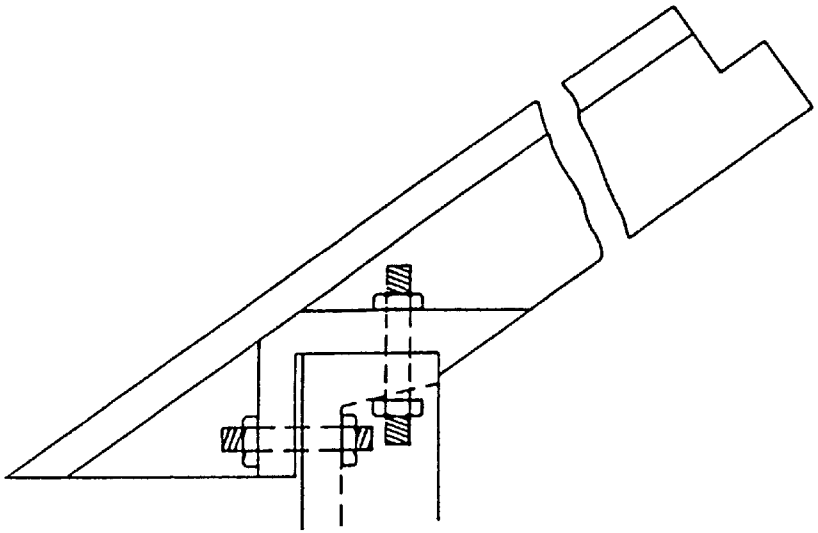
Figure 34G:
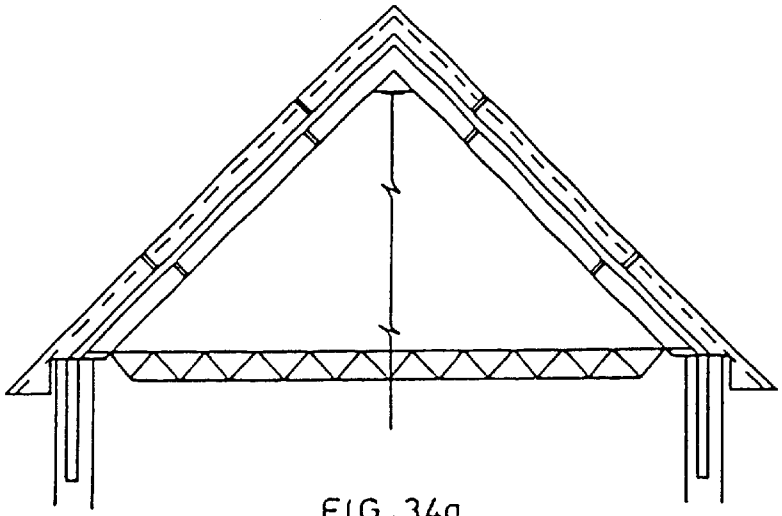
Figure 34I:
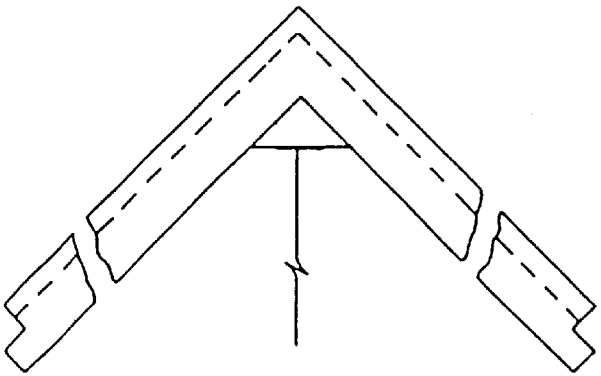
Figure 34K:
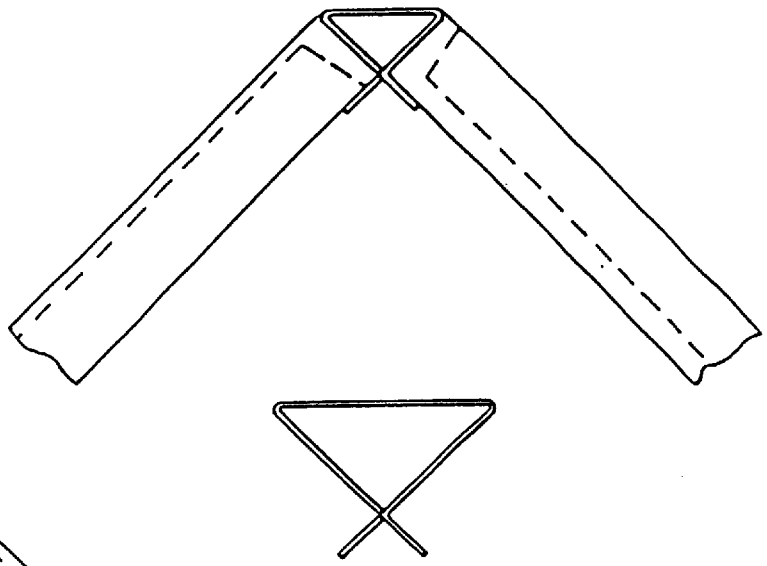
Figure 34L:
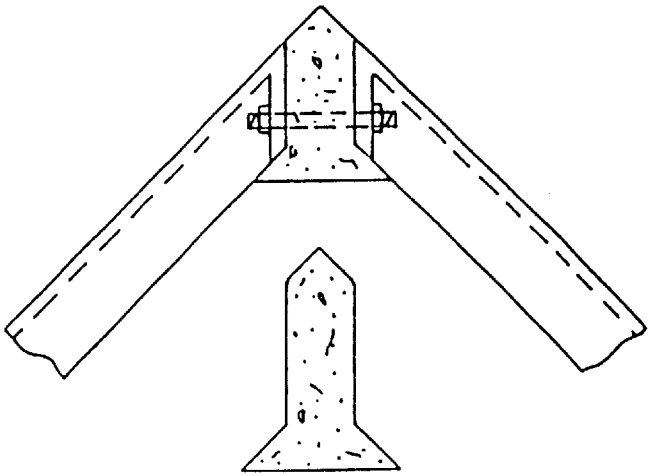
Figure 34J:
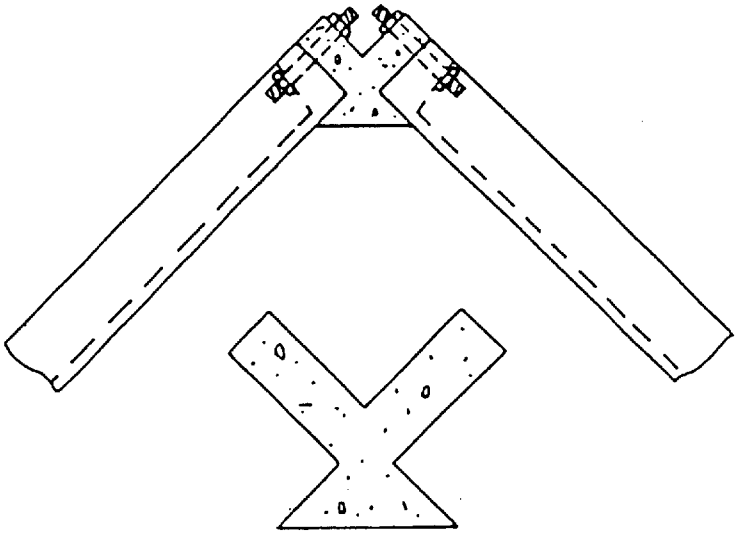

FIGS. 33*a* and 33*b* illustrate a preferred embodiment of the invention wherein a wall panel is specifically configured for use in interior corners. In this embodiment, the corner panel 554 is designed as discussed above for regular wall panels, but is provided with a return portion 556 on one of the end ribs 558. The return portion comprises preferably, a 12½" slab that extends from the end rib 558 towards the neighbouring rib 560 on the panel. In this manner, the return portion 556 is generally parallel to the slab 562 of the corner panel 554. The return portion 556 is provided with apertures 60 similar to those on the other ribs. In this manner, the end rib of a typical wall panel can be positioned adjacent and perpendicular to the corner panel 554 so as to form an interior corner. In this arrangement, the apertures in the end rib of the second panel would be at the same locations as apertures 60 of the return portion 556 thereby enabling the two panels to be connected together. In the preferred embodiment, the return portion 556, the end rib 558 to which it is attached, the adjacent rib 560, and a portion 566, of the slab 568, between the end rib 558 and the adjacent rib 560 have a thickness of 3" whereas the rest of the panel has a thickness of 2½" as in the regular wall panels. The increased thickness provides added strength to the corner of the wall being formed. Further, in order to ensure that the ribs are properly positioned to accommodate the application of drywall, the corner panel 554 preferably has a width of 8' 10" instead of the regular 8'. In this arrangement, once the second panel having a 10" depth, is positioned, the remaining width of the panel would be the typical 8'.

In manufacturing the corner panel 554 is preferably first formed as a typical wall panel described previously. Subsequently, concrete is poured to form the return portion 556. This alleviates any problems associated with stripping the forms from the complete panel. However, it is still possible to manufacture the corner panel in one step.

FIG. 34 illustrates various embodiments of the panels of the invention for use in constructing a roof for a building.

Figure 36:
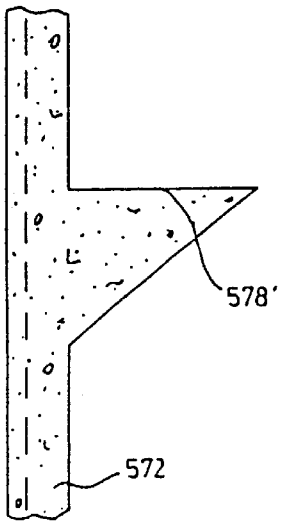
FIG. 36 is a partial side cross sectional view of another embodiment of the retaining wall of FIG. 35.
Figure 35:
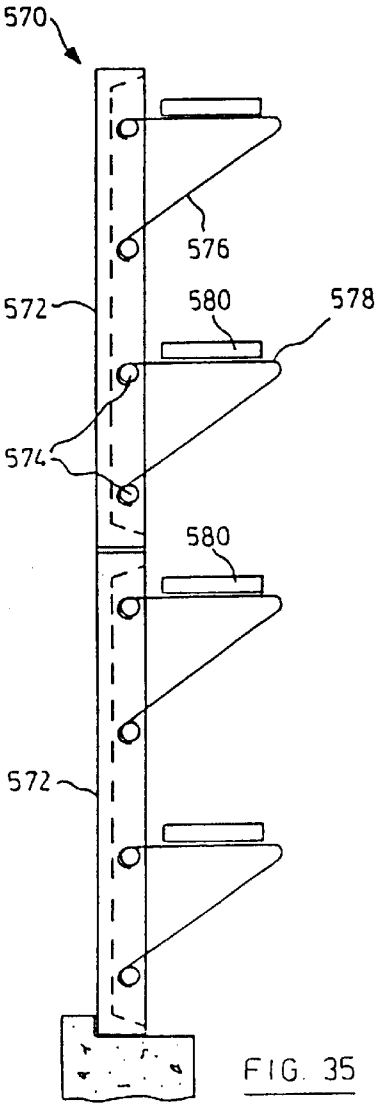
FIG. 35 is a side cross sectional view of another embodiment of the wall panel of the invention wherein the panel is used as a retaining wall.

FIG. 35 illustrates an embodiment of the invention wherein the panels described above are used to construct a retaining wall. As shown, the wall 570 is comprised of a number of stacked panels 572 each having apertures 574 as described above. Brackets 576 are provided which cooperate with the apertures to form ledges 578, which, in turn, support counter weights 580. As shown in FIG. 36, another embodiment of the invention comprises the wall panels 572 being formed with integral ledges 578' thereby removing the need for the brackets 576.

Figure 37:
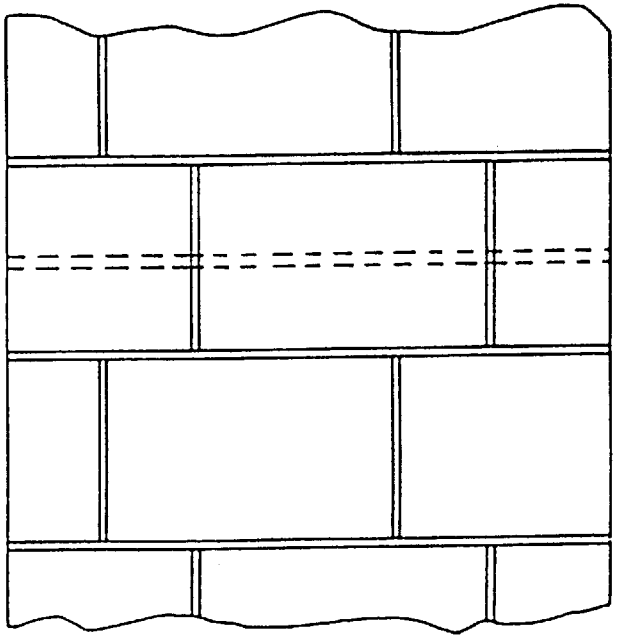
FIG. 37 is a perspective view of a wall panel according to another embodiment.
Figure 37:
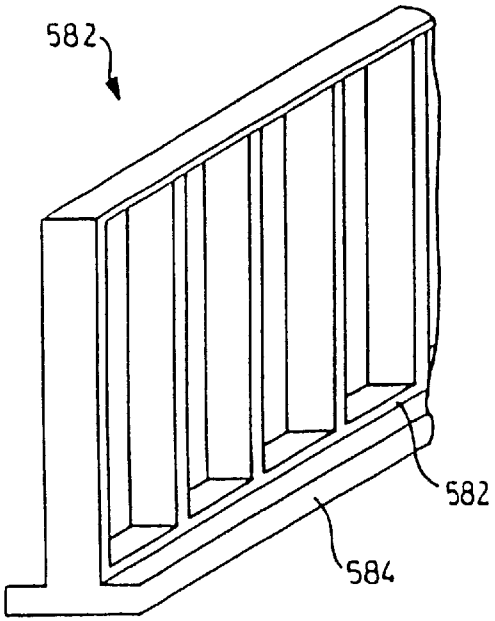

In another embodiment, the wall panels of the invention may be provided with a unitary footing as illustrated in FIG. 37. As shown, the wall panel 582, according to this embodiment, includes an integral footing 584 under the bottom beam 586 of the panel. With this arrangement, the need for separate footing is overcome.

Figure 38:
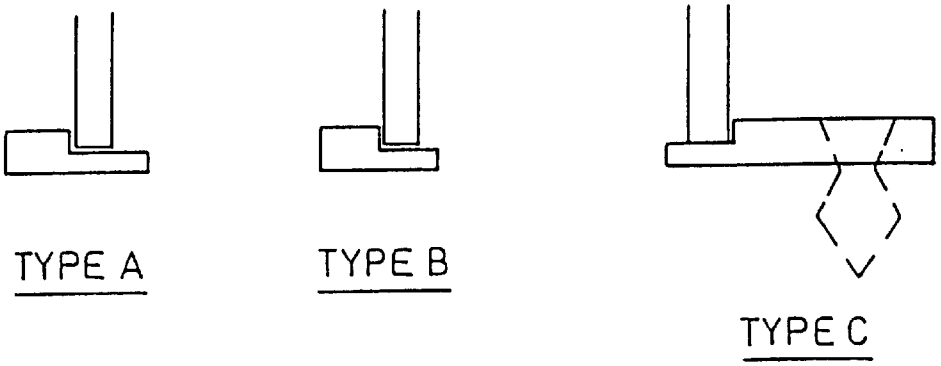
FIG. 38 is a rear elevation of a wall of a building comprising a plurality of wall panels of the invention arranged according to one embodiment.

FIG. 38 illustrates a further embodiment of the invention wherein a plurality of wall panels are stacked to form the walls of a multi-level building. In this embodiment, the wall panels are staggered so as to avoid a continuous seam. The panels are bolted together as described above since although staggered, the apertures in the ribs would still be in line.

Figure 39:
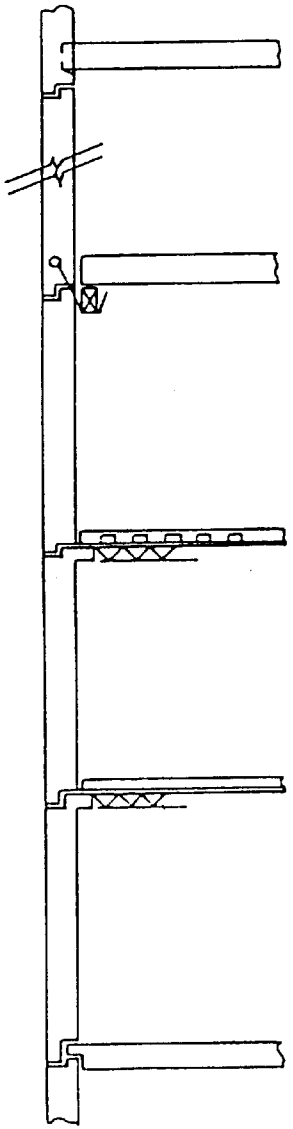
FIG. 39 is a side cross sectional view of a wall of a building comprising a plurality of wall panels of the invention and illustrating various embodiments of flooring.

FIG. 39 illustrates a wall of a multi-level building wherein a variety of flooring systems are used. The flooring systems shown are described above.

Figure 40:
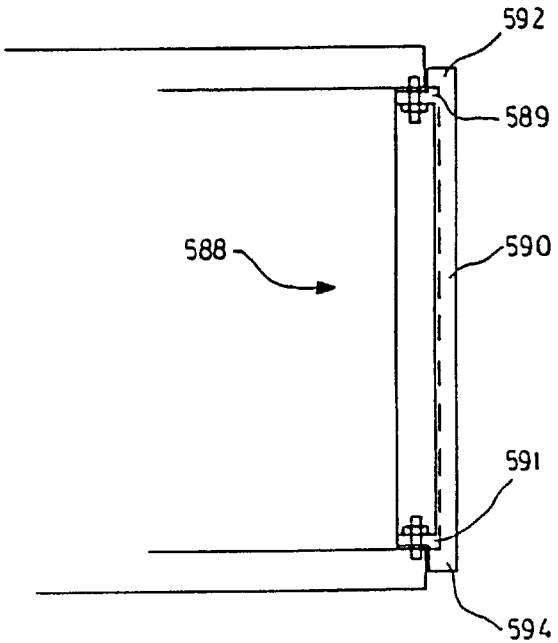
FIG. 40 is a side cross sectional view of a wall panel according to another embodiment of the invention

FIG. 40 illustrates a further embodiment wherein a wall panel 588 serves to form a curtain wall. In this case, the slab 590 of the panel 588 is extended past the top and bottom beams 589 and 591, respectively to result in top and bottom flanges 592 and 594, respectively. The top and bottom beams 589 and 591 are then bolted to the floors of the building.

The weight of the above panels may be reduced by using lightweight concrete in the forming process. It will be understood that the strength of the concrete will be determined by the required engineering specifications for the subject building. Further, where appropriate, the metal reinforcing material may be omitted in favour of other known reinforcing means such as fiberglass or vinyl strings etc. Preferably, such alternate reinforcing means will only be used for buildings less than four stories in height.

The above concrete panel system results in a building that can be specifically engineered to withstand earthquakes. Further, such buildings would also be suited for areas having unstable soils and areas that are subject to cyclones and flooding.

Figure 41A:
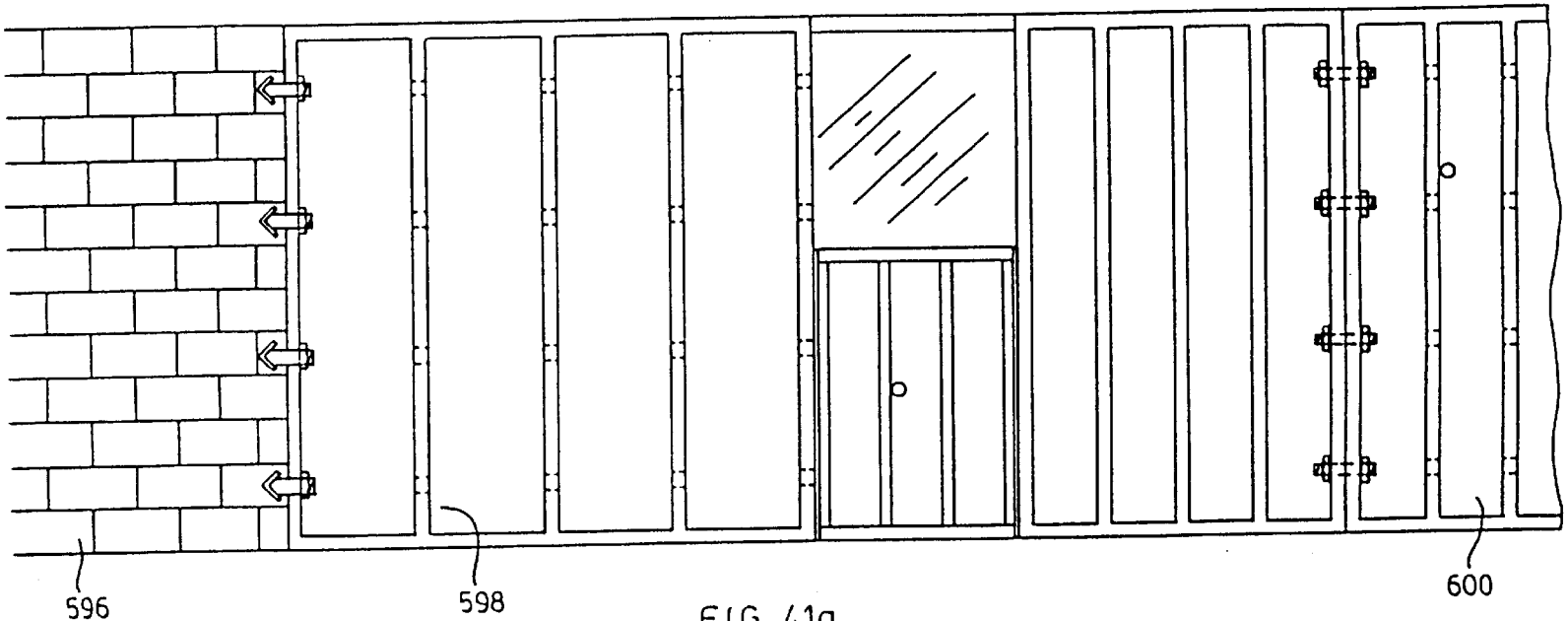
FIGS. 41*a* and 41*b* illustrate the application of wall panels of the invention in existing structures.
Figure 41B:
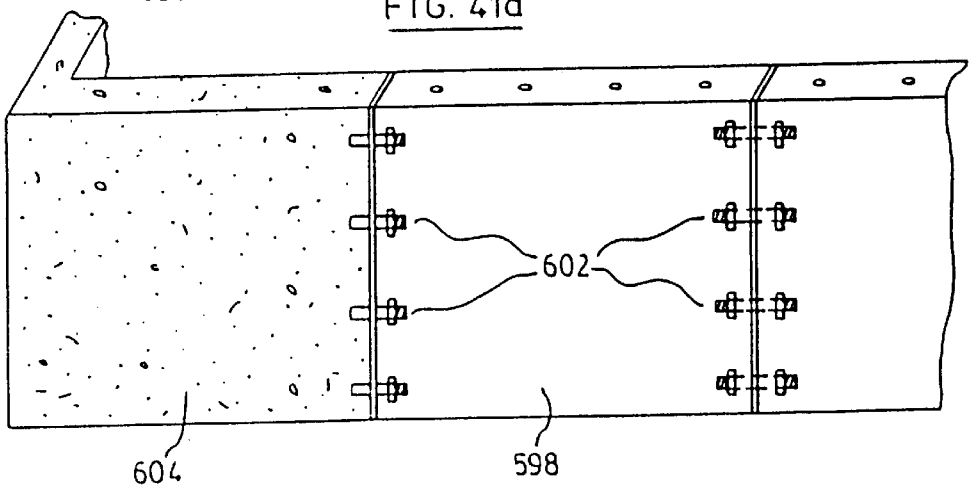

In addition to being used for new construction, the panels of the invention can also be used in a "retrofit" manner in buildings constructed by conventional methods. The preferred size of the panels, as described above, makes them compatible for this purpose since they are designed in accordance with existing North American building standards. An example of this is illustrated in FIG. 41*a* wherein a wall panel 598 is bolted to an existing concrete block wall 596. Also shown is the connection of a wall panel of the invention to an exiting wood or metal stud wall 600 in accordance with conventional construction methods. In both cases, the wall panel can be attached to the existing structure using the bolts as described above. Such bolts are shown at 602. FIG. 41*b* illustrates the connection of a wall panel of the invention to an existing poured concrete wall 604.

Once the wall or roof panels described above are erected, they may be insulated and finished by any variety of known methods.

Although the invention has been described with reference to certain specific embodiments, various modifications thereof will be apparent to those skilled in the art without departing from the spirit and scope of the invention as outlined in the claims appended hereto.

What is claimed is:

1. A concrete building panel comprising:

a concrete slab having first and second generally planar faces and top and bottom ends;

a generally box-like, concrete frame connected to the first face of said slab, said box-like frame having generally the same dimensions as said slab face and comprising vertically spaced, generally horizontal top and bottom beams, each beam being connected to a plurality of generally vertical, horizontally spaced ribs extending between said top and bottom beams;

and a means for connecting said frame to said slab whereby said frame and slab are maintained in a rigid, spaced apart arrangement thereby providing a continuous air space between said slab and said frame.

2. The panel of claim 1 wherein said panel is used to form a wall of a building.

3. The panel of claim 1 wherein insulating material is provided selected locations between the first face of said slab and said ribs and beams.

4. The panel of claim 3 wherein said insulation is made of a rigid material.

5. The panel of claim 1 wherein said means for connecting comprises a rigid reinforcing material.

6. The panel of claim 5 wherein said means for connecting comprises re-bar.

7. The panel of claim 1 wherein said ribs are provided with a plurality of apertures.

8. A wall structure comprising a plurality of wall panels as claimed in claim 1, each said panels being connected together.

9. The wall of claim 8 wherein said plurality of panels are joined by first connectors in the top and bottom beams of adjacent panels.

10. The wall of claim 9 wherein said plurality of panels are further joined by second connectors extending between opposing ribs of adjacent panels.

* * * * *